US009562361B2

(12) United States Patent
Bilge

(10) Patent No.: US 9,562,361 B2
(45) **Date of Patent: *Feb. 7, 2017**

(54) SYSTEM FOR MOUNTING WALL PANELS TO A WALL STRUCTURE

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 21 days.

This patent is subject to a terminal disclaimer.

(21) Appl. No.: 14/256,384

(22) Filed: Apr. 18, 2014

(65) Prior Publication Data

US 2014/0223850 A1 Aug. 14, 2014

Related U.S. Application Data

(63) Continuation-in-part of application No. 13/868,574, filed on Apr. 23, 2013, now Pat. No. 8,739,483, and a (Continued)

(51) Int. Cl.
*E04F 13/08* (2006.01)
*E04F 13/07* (2006.01)
(Continued)

(52) U.S. Cl.
CPC ..... *E04F 13/0858* (2013.01); *E04F 13/07* (2013.01); *E04F 13/0803* (2013.01);
(Continued)

(58) Field of Classification Search
CPC .... E04F 13/0814; E04F 13/12; E04F 13/0889; E04F 13/0803; E04F 13/0812; E04F 13/07; E04F 13/0805; E04F 13/0851; E04F 13/0891; E04F 13/0858; E04C 2/292; E04C 2/08; E04B 2/18
See application file for complete search history.

(56) References Cited

U.S. PATENT DOCUMENTS 1,655,406 A 1/1928 Bennett
1,726,500 A 8/1929 Norris
(Continued)

FOREIGN PATENT DOCUMENTS

DE 3732534 A1 4/1989
DE 3732535 A1 4/1989
(Continued)

OTHER PUBLICATIONS

Bamco Inc., G500 Wall System.

*Primary Examiner* — Charles A Fox
*Assistant Examiner* — Charissa Ahmad
(74) *Attorney, Agent, or Firm* — Richard M. Goldberg

(57) ABSTRACT

A system for mounting wall panels to a wall, includes wall panels, each including a main wall panel, and at least two bent end sections with a cut-out section and a wall thickness; and a plurality of main fastening extrusions, each including a base section to be secured to the wall, and two parallel, spaced apart flexible and resilient bent end securing walls extending from the base section, each bent end securing wall including a projection facing the other bent end securing wall, the bent end securing walls spaced apart corresponding to the wall thickness of two bent end sections, such that pressing of the bent end sections into the spacing between the bent end securing walls causes biasing away of the bent end securing walls until the projections engage in respective cut-out sections.

11 Claims, 33 Drawing Sheets

Related U.S. Application Data continuation-in-part of application No. 13/747,035, filed on Jan. 22, 2013, now Pat. No. 8,833,015.

(51) Int. Cl.
*E04F 13/12* (2006.01)
*E04C 2/08* (2006.01)

(52) U.S. Cl.
CPC ..... *E04F 13/0805* (2013.01); *E04F 13/0851* (2013.01); *E04F 13/0889* (2013.01); *E04F 13/0891* (2013.01); *E04F 13/12* (2013.01); *E04C 2/08* (2013.01)

(56) References Cited

U.S. PATENT DOCUMENTS 1,833,174 A 11/1931 Norris
2,059,483 A 11/1936 Parsons
2,066,205 A 12/1936 Keating
2,082,241 A 6/1937 Bennett
2,245,785 A * 6/1941 Jentzer, Jr. ..... E04F 13/0803 52/288.1
2,607,971 A 8/1952 Beford
2,789,321 A 4/1957 Adams
2,803,321 A 8/1957 Fox-Williams
3,021,915 A 2/1962 Kemp
3,228,163 A * 1/1966 Lindstrom ..... E04B 9/26 52/506.09
3,367,077 A * 2/1968 Johnston ..... E04B 2/96 52/204.591
3,671,061 A 6/1972 Dawdy
3,858,377 A 1/1975 Browne et al.
4,332,119 A 6/1982 Toews
4,344,267 A 8/1982 Sukolics
4,452,029 A 6/1984 Sukolics
4,573,300 A 3/1986 Bezner
4,640,064 A 2/1987 Goodworth, II
4,667,579 A 5/1987 Daw
4,696,142 A 9/1987 Mieyal et al.
4,829,740 A 5/1989 Hutchison
4,833,839 A 5/1989 Kurose
4,833,858 A 5/1989 Hutchison
5,050,360 A * 9/1991 Gailey ..... E04B 9/0478 52/506.06
5,263,292 A 11/1993 Holland et al.
5,579,624 A 12/1996 Aeberhard
5,644,878 A 7/1997 Wehrmann
5,809,729 A 9/1998 Mitchell
5,996,301 A 12/1999 Conterno
6,101,777 A 8/2000 Bodine et al.
6,164,024 A 12/2000 Konstantin
6,205,733 B1 3/2001 LaLonde
6,330,772 B1 12/2001 Mitchell et al.
6,430,885 B1 8/2002 Ito
6,536,175 B2 3/2003 Conterno
6,745,527 B1 6/2004 Sherman et al.
6,751,916 B1 6/2004 Ritzer et al.
6,892,500 B2 5/2005 Zaborowski
7,210,273 B2 5/2007 Zahner, III
7,472,521 B2 1/2009 Bilge
7,621,084 B2 11/2009 Bilge
7,752,818 B1 7/2010 Roegge et al.
8,127,507 B1 3/2012 Bilge
8,166,716 B2 5/2012 Macdonald et al.
8,225,572 B2 7/2012 Wallace
8,256,181 B2 9/2012 Voegele, Jr. et al.
8,307,607 B2 11/2012 Conterno
8,316,609 B2 11/2012 Ben-Zvi
8,347,569 B1 1/2013 McIntyre et al.
2001/0022058 A1 9/2001 Conterno
2002/0035811 A1 3/2002 Heuel
2002/0152704 A1 10/2002 Thompson et al.
2004/0134143 A1 7/2004 Boyer
2009/0049770 A1 2/2009 Konstantin
2009/0241444 A1 10/2009 Griffiths
2009/0241451 A1 10/2009 Griffiths
2011/0225926 A1 * 9/2011 Conterno ..... E04F 10/02 52/782.1

FOREIGN PATENT DOCUMENTS

EP 2166169 A1 3/2010
GB 2135355 A 8/1984
JP 8-189176 A 7/1997

* cited by examiner

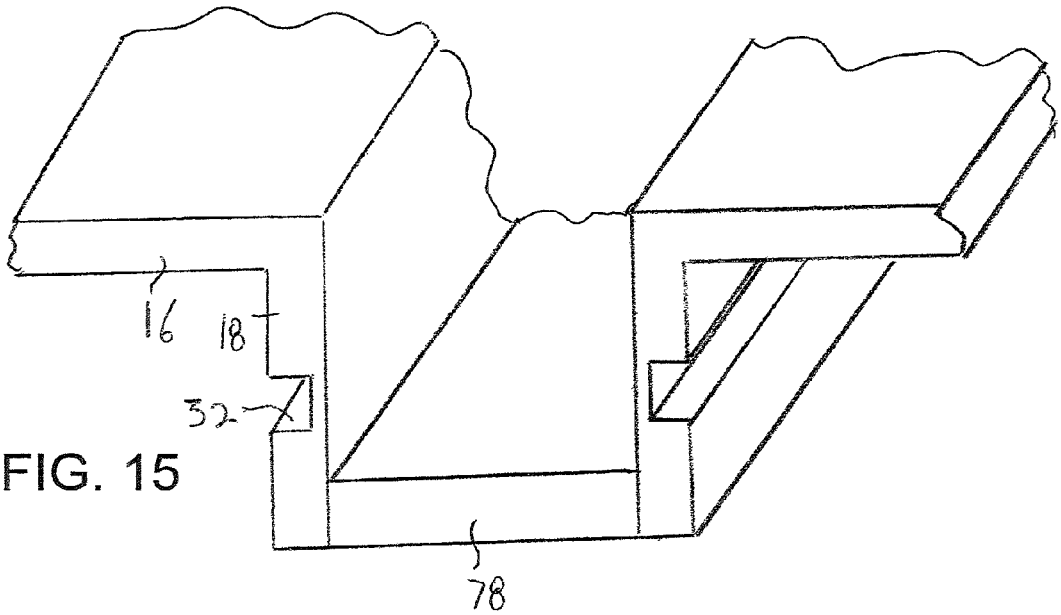
FIG. 15
FIG. 16
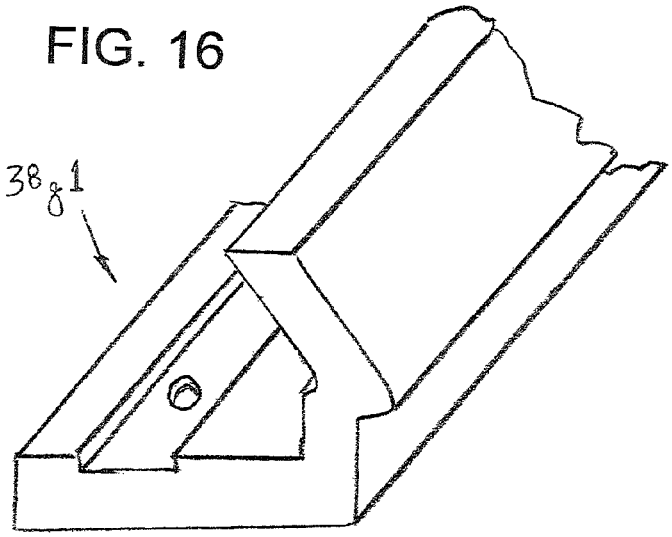

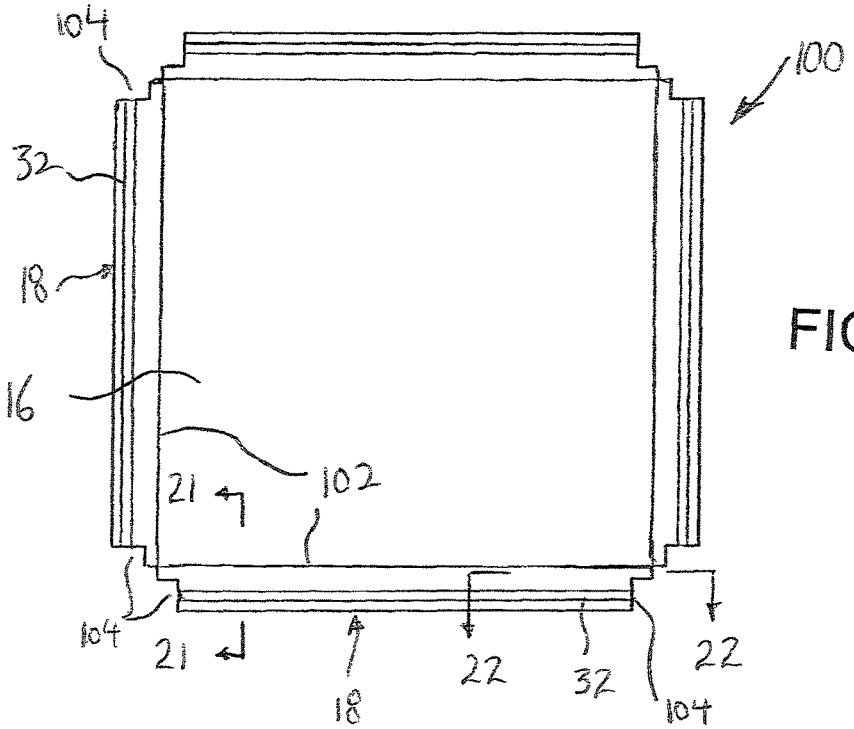
FIG. 20
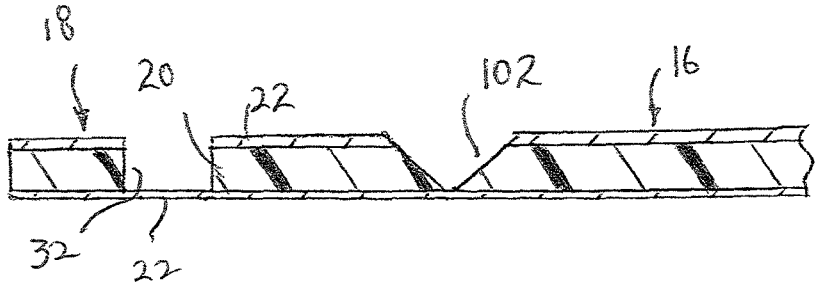
FIG. 21
FIG. 22
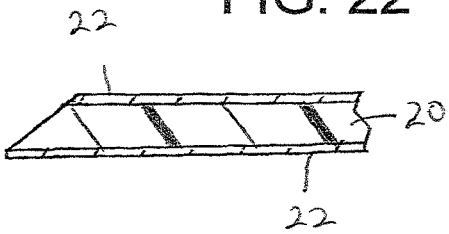

SYSTEM FOR MOUNTING WALL PANELS TO A WALL STRUCTURE

REFERENCE TO RELATED APPLICATION

The present application is a Continuation-In-Part of U.S. patent application Ser. No. 13/868,574 to the same inventor herein, filed Apr. 23, 2013, which in turn, is a Continuation-In-Part of U.S. patent application Ser. No. 13/747,035 to the same inventor herein, filed Jan. 22, 2013.

BACKGROUND OF THE INVENTION

The present invention relates generally to a wall system, and more particularly, to a system for easily mounting wall panels over an existing wall structure.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes some of these problems is sold by Bamco Inc. of 30 Baekeland Ave., Middlesex, N.J. 08846 under the designation "G500 WALL SYSTEM." With this system, the wall panels are provided with right angle or bends at their edges. Each planar panel and the right angle bend together form an L-shape. Each bend is secured by screws to a fastening extrusion having the same linear dimension as the wall panel, and the fastening extrusion has a generally rectangular cross-sectional configuration. At each joint area where two panels meet, there are two such fastening extrusions connected together, each secured to a respective wall panel, with an elongated hard silicone gasket between the fastening extrusions. The fastening extrusions are arranged one above the other at each joint area. Thus, the screws are not visible, thereby eliminating the unsightly appearance of previous system.

However, because of the L-shape at the bends at the edges of the wall panels, it is necessary to separately secure each bend to a fastening extrusion by screws, in addition to securing the fastening extrusions to the wall structure by screws, further increasing the work required to assemble the wall panels. Also, because the bends in the wall panels extend only in a direction perpendicular to the wall panels, the only structural support is provided by the screws which secure each bend to a fastening extrusion. As a result, it is possible to loosen and/or pull out the wall panels.

In addition, in order to secure the fastening extrusions to existing wall structures, one of the connected pair of fastening extrusions is provided with an extension which is separately secured to the existing wall structure. This means that the main bodies of the fastening extrusions are spaced away from the existing wall structure, thereby providing a further weak link in the structure, besides making it more difficult to assemble.

U.S. Pat. Nos. 7,472,521 and 7,621,084, by the same inventor herein disclose systems for mounting wall panels to an existing wall structure, which includes a plurality of wall panels. There are also a plurality of fastening extrusions. Each fastening extrusion includes a securing section for securing the fastening extrusion to the existing wall structure, and a retaining wall structure at one end of the securing section, the retaining wall structure including a recess which receives one hook wall of the wall panel.

The main panel section has a rectangular configuration with four hook walls, and there are four fastening extrusions, with the recess of the retaining wall of each fastening extrusion receiving one hook wall of the wall panel. Each U-shaped cross-sectional profile defines a recess therein, and each fastening extrusion includes at least one stabilizing wall extending from a free end of a respective retaining wall, with the stabilizing wall being received in one recess of a respective U-shaped cross-sectional profile. Each stabilizing wall has an L-shaped cross-sectional profile. Also, the securing section and the retaining wall structure together define a U-shaped cross-sectional profile.

A first one of the fastening extrusions includes a tongue and a second one of the fastening extrusions includes a groove for receiving the tongue to connect together the first and second fastening extrusions when the first fastening extrusion is assembled with a first wall panel and the second fastening extrusion is assembled with a second wall panel. In a later embodiment, there is only a single fastening extrusion.

There is also at least one channel secured to the securing sections of adjacent fastening extrusions and positioned between adjacent wall panels corresponding thereto. An elongated plug is inserted into each channel for closing off the gap between adjacent wall panels.

This arrangement, however, requires the insertion of screws into the fastening extrusions and the channel while supporting the wall panels, which can be burdensome. It also requires the separate channels and plugs in order to close off the gap between adjacent wall panels to provide an aesthetic appearance between the wall panels. If the gap between adjacent panels is varied, this would also require a plurality of different size plugs, which can further add to the cost of the structure.

A further system has been sold for more than one year by Creative Metal Contractors Inc. of Toms River, N.J., which uses a single fastening extrusion having tongues extending from opposite sides thereof. The single fastening extrusion is secured to the existing wall by screws at a central portion thereof between the tongues. Each wall panel has a main panel section and hook walls at edges of the main panel section, with the main panel section and each hook wall having a U-shaped cross-sectional profile. Fasteners or frame extrusions are secured to the hook walls, with each fastener including walls defining a recess which receives a corresponding tongue of the single fastening extrusion, such that the tongues are spaced away from the hook walls. A compressed joint plug is positioned in overlying relation to the screws and between adjacent hook walls to provide an aesthetic appearance.

However, with this latter arrangement, plugs are also required, with the same consequent disadvantages. It may also be difficult to align the recesses over the tongues of the single fastening extrusion. In addition, the single fastening extrusions are secured to the existing wall by screws only through the center of the fastening extrusions, which can result in failure of such securement. Still further, if the gap between adjacent panels is varied, this would also require a plurality of different size plugs, which can further add to the cost of the structure.

In addition, in the latter arrangement, the gap between adjacent wall panels is sealed with a silicone sealant and a compressed joint plug. As a result, the air pressure behind the wall panels varies relative to the ambient air pressure in front of the panels. However, architectural requirements require the air pressures to be the same or equalized so as not to reduce the longevity of the wall structure of the building.

The invention of U.S. Pat. No. 8,127,507 to the same inventor herein also requires the insertion of screws into the fastening extrusions and the channel while supporting the wall panels, which can be burdensome. It also requires the separate decorated panels in order to close off the gap between adjacent wall panels to provide an aesthetic appearance between the wall panels.

U.S. patent application Ser. No. 12/652,879, to the same inventor herein, attempts to cure the aforementioned problems, by providing a wall system which does not require the use of screws to secure the wall panels to the fastening extrusions. Rather, the wall panels have recesses into which the frame extrusions fit, and which also eliminates the use of plugs to cover the gap between adjacent wall panels. This permits easy hanging of the wall panels by providing a male connecting frame extrusion that merely fits within a female connecting wall panel.

It is also known from U.S. Pat. No. 4,344,267 to Sukolics, U.S. Pat. No. 4,829,740 to Hutchison and U.S. Pat. No. 5,809,729 to Mitchell, to provide a wall system with L-shaped ends of the panels that include recesses in the bent ends that engage with projections of the extrusions secured by screws to the walls. However, with these patents, there is still a large gap between adjacent bent ends, which is necessary for securing the panels to the extrusions, and which also thereby requires a plug to close this gap.

SUMMARY OF THE INVENTION

Accordingly, it is an object of the present invention to provide a wall system that overcomes the aforementioned problems.

It is another object of the present invention to provide a wall system which does not require the use of screws to secure the wall panels to the fastening extrusions.

It is still another object of the present invention to provide a wall system in which the wall panels are merely pressed into place and retained therein by spring-like extrusions secured to the walls.

It is yet another object of the present invention to provide a wall system that is easy to assemble with an existing wall structure.

It is a further object of the present invention to provide a wall system that permits sliding of the walls panels on the extrusions.

It is a further object of the present invention to provide a wall system that is easy and economical to manufacture and use.

In accordance with an aspect of the present invention, a system for mounting wall panels to an existing wall structure, includes a plurality of wall panels, each wall panel including a main wall panel, and at least two bent end sections extending at an angle from different edges of the main wall panel, each bent end section having a wall thickness. There is at least one main fastening extrusion, each fastening extrusion including at least one base section adapted to be secured to the existing wall structure, and two spaced apart flexible and resilient bent end securing walls extending at an angle from the at least one base section. A cut-out recess is provided at a first surface of at least one bent end section which faces a second surface of a respective bent end securing wall. A projection is provided at the second surface of each bent end securing wall that faces a respective cut-out recess, with a spacing between the projections of the two bent end securing walls being less than the wall thickness of two bent end sections. Further, each bent end securing wall is formed in an arcuate configuration having a curvature extending away from the other bent end securing wall and having an inward termination formed by a respective projection. Pressing of the bent end sections into the spacing between the projections causes at least one bent end securing wall to be biased away from the other bent end securing wall until the projections engage in respective cut-out sections to permit the bent end securing walls to spring back to lock the bent end sections in the spacing.

Each bent end securing wall further includes an extension that extends from the respective projection away from the other bent securing wall. Each cut-out section has a cut-out holding surface that is substantially parallel to the main wall panel, or extending at an angle away from the main wall panel. In like manner, each projection has a projection holding surface for engaging with a respective cut-out holding surface. The bent securing walls are dimensioned such that, when each projection engages in a respective cut-out section, a free end of each extension of the bent end securing wall engages an undersurface of the respective main panel section, so as to lock the bent end section in the spacing in a tight fitting manner.

Each projection also has an inclined surface which terminates in the projection holding surface thereof, and each cut-out has an inclined surface which terminates in the cut-out holding surface thereof.

In addition, each bent end section has a lower end with a beveled surface for engaging with the inclined surface of the respective projection when the bent end section is pressed into the spacing between the bent end securing walls to cause the respective bent end securing wall to be biased away from the other bent end securing wall until the projection engages in the respective cut-out section.

Preferably, each fastening extrusion is formed as a one-piece, unitary construction. However, it is also possible that each fastening extrusion includes at least two separate base sections adapted to be secured to the existing wall structure; and at least two spaced apart flexible and resilient bent end securing walls, each extending at an angle from one of the base sections.

With the above curved wall structure, the projections are the only part of the bent end securing walls that are in contact with the bent end sections.

There are also a plurality of corner fastening extrusions, each corner fastening extrusion including a corner base section adapted to be secured to one corner wall of the existing wall structure, and a flexible and resilient corner bent end securing wall extending at an angle from the base section, each corner bent end securing wall including a corner projection at one surface thereof facing another adjacent corner wall of the existing wall structure when the base section is secured to the one corner wall. The corner base section has dimensions to space the flexible and resilient corner bent end securing wall from the adjacent corner wall such that a spacing between the adjacent corner wall and the corner projection is less than the wall thickness of one the bent end section. Thus, pressing of a the bent end section into the spacing between the corner bent end securing wall and the adjacent corner wall causes the corner bent end securing wall to be biased away from the adjacent corner wall until the corner projection engages in a respective cut-out section to lock the bent end section in the spacing in a manner that an outer wall of the bent end section is least in near abutting relation with the adjacent corner wall.

The corner bent end securing wall is formed in an arcuate configuration having a curvature extending away from the adjacent corner wall and having an inward termination formed by the corner projection.

In accordance with another aspect of the present invention, a system for mounting wall panels to an existing wall structure, includes a plurality of wall panels, each wall panel including a main wall panel, and at least two bent end sections extending at an angle from different edges of the main wall panel, each bent end section having a wall thickness. There is also at least one main fastening extrusion, each fastening extrusion including at least one base section adapted to be secured to the existing wall structure, and two spaced apart flexible and resilient bent end securing walls extending at an angle from the at least one base section, the two bent end securing walls having a first spacing therebetween substantially greater than the wall thickness of two bent end sections, and at least one further wall positioned between the spaced apart bent end securing walls. A cut-out recess is provided at a first surface of at least one bent end section which faces a second surface of a respective bent end securing wall. A projection is provided at the second surface of each bent end securing wall that faces a respective cut-out recess, with a second spacing between the projection of each bent end securing wall and the at least one further wall being less than the wall thickness of one the bent end section. Thus, pressing of each bent end section into a respective second spacing between one the bent end securing wall and the at least one further wall causes the bent end securing wall to be biased away from the at least one further wall until the respective projection engages in a respective cut-out section to permit the bent end securing wall to spring back to lock the bent end section in the second spacing.

In one embodiment, the at least one base section includes two spaced apart base sections adapted to be secured to the existing wall structure, with the flexible and resilient bent end securing wall extending at an angle from each base section, and the at least one further wall includes a spacer member positioned between the two base sections, with the spacer member having opposite ends, each end separated from a respective bent end securing wall by a distance substantially equal to the wall thickness of one the bent end section. In such case, each bent end section has dimensions such that pressing of the bent end section into the second spacing causes the respective bent end securing wall to be biased away from the spacer member until the projection engages in the respective cut-out section.

In another embodiment, the at least one further wall includes two inner walls, each connected to either one bent end securing wall, or the at least one base section. Each inner wall is connected inwardly of a respective bent end securing wall, with the second spacing between the projection of each bent end securing wall and the respective inner wall of the at least one further wall being less than the wall thickness of one bent end section. Each bent end section has dimensions such that pressing of the bent end section into the second spacing between the respective projection and a the inner wall causes the respective bent end securing wall to be biased away from the other bent end securing wall until the projection engages in the respective cut-out section, so as to lock the bent end section in the spacing.

In another embodiment, each inner wall is connected by a lateral connecting wall to a respective bent end securing wall with a third spacing between each lateral connecting wall and the at least one base section, and there is a closure member extending in the third spacing.

In another embodiment, each inner wall is connected to the at least one base section, and a free inner surface of each inner wall is provided with at least one barb that is angled toward the at least one base section, and there is a plug inserted between the inner walls and engaged by the barbs.

In accordance with another aspect of the present invention, a system for mounting wall panels to an existing wall structure, includes a plurality of wall panels, each wall panel including a main wall panel, and at least two bent end sections extending at an angle from different edges of the main wall panel, with at least two bent end sections meeting at least one corner, and each bent end section having a wall thickness. There is at least one main fastening extrusion, each fastening extrusion including at least one base section adapted to be secured to the existing wall structure, and two spaced apart flexible and resilient bent end securing walls extending at an angle from the at least one base section. There is a cut-out recess at a first surface of at least one bent end section which faces a second surface of a respective bent end securing wall. There is a projection at the second surface of each bent end securing wall that faces a respective cut-out recess, with a spacing between the projections of the two bent end securing walls being less than the wall thickness of two bent end sections. Slots are provided at opposite ends of the bent end sections to permit sliding of each wall panel on respective extrusions when a projection is engaged in a respective cut-out section. In addition, there is a corner opening formed by a cut-away section at an end edge of each bent end section and in open communication with a respective slot.

The above and other features of the invention will become readily apparent from the following detailed description thereof which is to be read in connection with the accompanying drawings.

BRIEF DESCRIPTION OF THE DRAWINGS

FIG. 15 is a perspective view of the wall panels and spacer member of FIG. 14;

FIG. 16 is a perspective view of the frame extrusion of FIG. 16;

FIG. 20 is a top plan view of a planar blank used for forming a wall panel;

FIG. 21 is a cross-sectional view of the planar blank of FIG. 20, taken along line 21-21 thereof;

FIG. 22 is a cross-sectional view of the planar blank of FIG. 20, taken along line 22-22 thereof;

DETAILED DESCRIPTION

Figure 1:
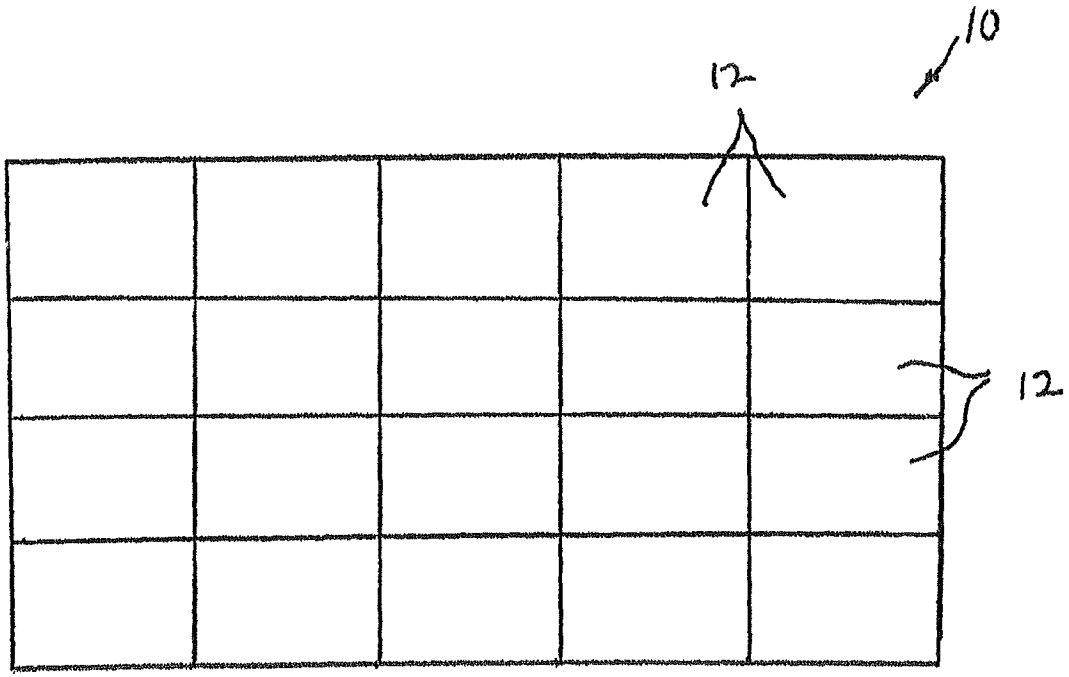
FIG. 1 is an elevational view of a plurality of wall panels mounted to an existing wall structure.

Referring to the drawings in detail, there is shown a system 10 according to the present invention for easily mounting wall panels 12 over an existing wall structure 14. Wall structure 14 preferably includes any planar wall. Each panel 12 includes a rectangular shaped, planar main panel section 16 and at least two bent end sections 18 bent at a right angle in the same direction at edges of main panel section 16. Main panel 16, however, need not be planar, and in fact, can have different shapes, such as a wave shape, etc. to provide different aesthetic appearances. Preferably, there are four bent end sections 18 at each edge of main panel section 16 which form an L-shaped cross-sectional shape thereat. However, the invention is not limited thereby and wall panels 12 can be formed with two, three or four bent end sections 18. Wall panels 12 are formed preferably by, but not limited to, a polyethylene core 20 with a thin aluminum wall 22 covering opposite sides thereof, as shown in FIG. 5. However, for the sake of simplicity in the drawings, FIGS. 3 and 4 show wall panels 12 formed of only a single material.

Figure 2:
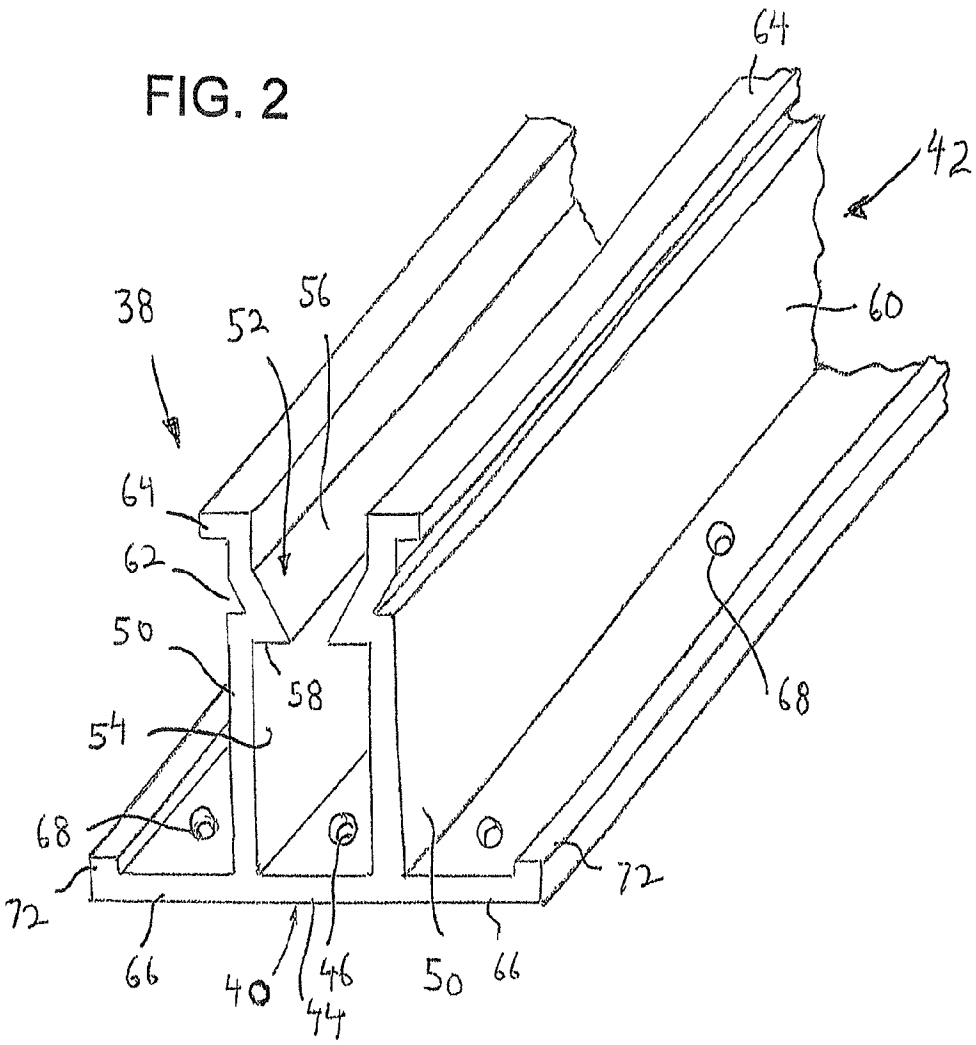
FIG. 2 is a perspective view of a frame extrusion according to the present invention.
Figure 4:
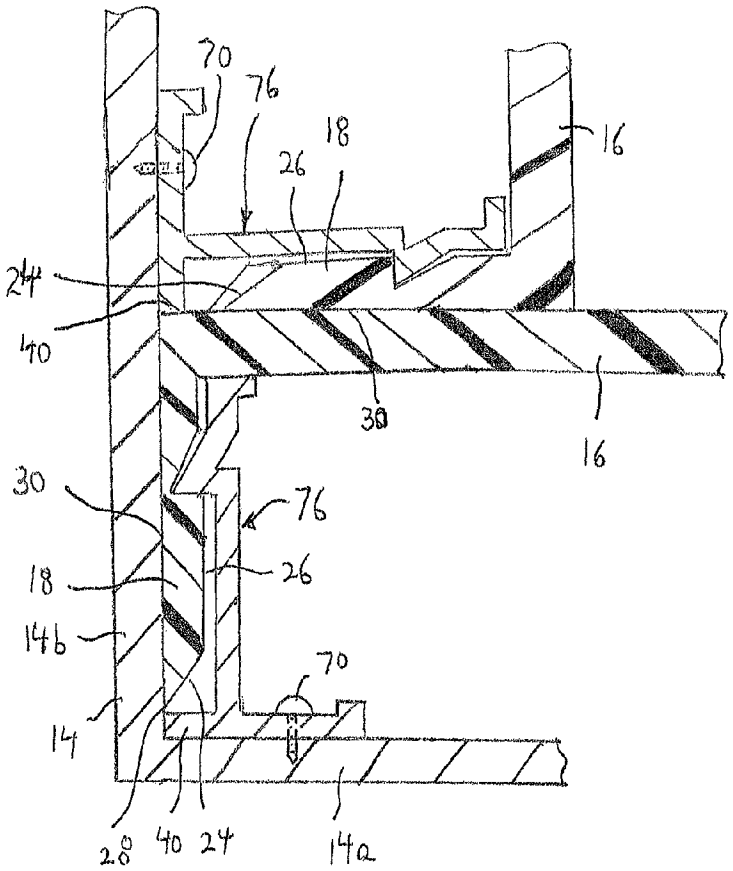
FIG. 4 is a cross-sectional view showing two wall panels connected together by a corner fastening extrusion.
Figure 5:
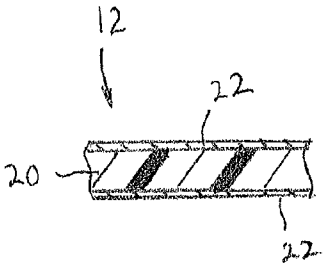
FIG. 5 is a cross-sectional view of a wall panel.

As shown in FIGS. 2 and 4, each bent end section 18 is formed with a lower beveled or inclined surface 24 at the inner surface 26 thereof and extending to a line edge 28 at the distal end of the bent end section 18 at the outer surface 30 thereof. As a result, there is a reduction in thickness of the bent end section 18 at the lower end thereof. Lower beveled surface 24 preferably extends along the entire length of the bent end section 18, although the present invention is not so limited, that is, lower beveled surface 24 can extend along only a part of the length of bent end section 18.

In addition, each bent end section 18 includes a cut-out section 32 at the inner surface 26 thereof and spaced slightly away from main panel section 16. Each cut-out section 32 preferably has a nose-shaped configuration in cross-section, although the present invention is not limited thereby. Specifically, each cut-out section 32 has an inclined surface 34 that extends toward the distal end of the bent end section 18 at the outer surface 30 thereof, and terminates at a holding surface 36 that extends parallel to main panel section 16. As a result, cut-out section 32 effectively forms a notch in the inner surface of bent end section 18. Cut-out section 32 preferably extends along the entire length of the bent end section 18, although the present invention is not so limited, that is, cut-out section 32 can extend along only a part of the length of bent end section 18, or there may be a plurality of spaced apart cut-out sections 32.

Figure 3:
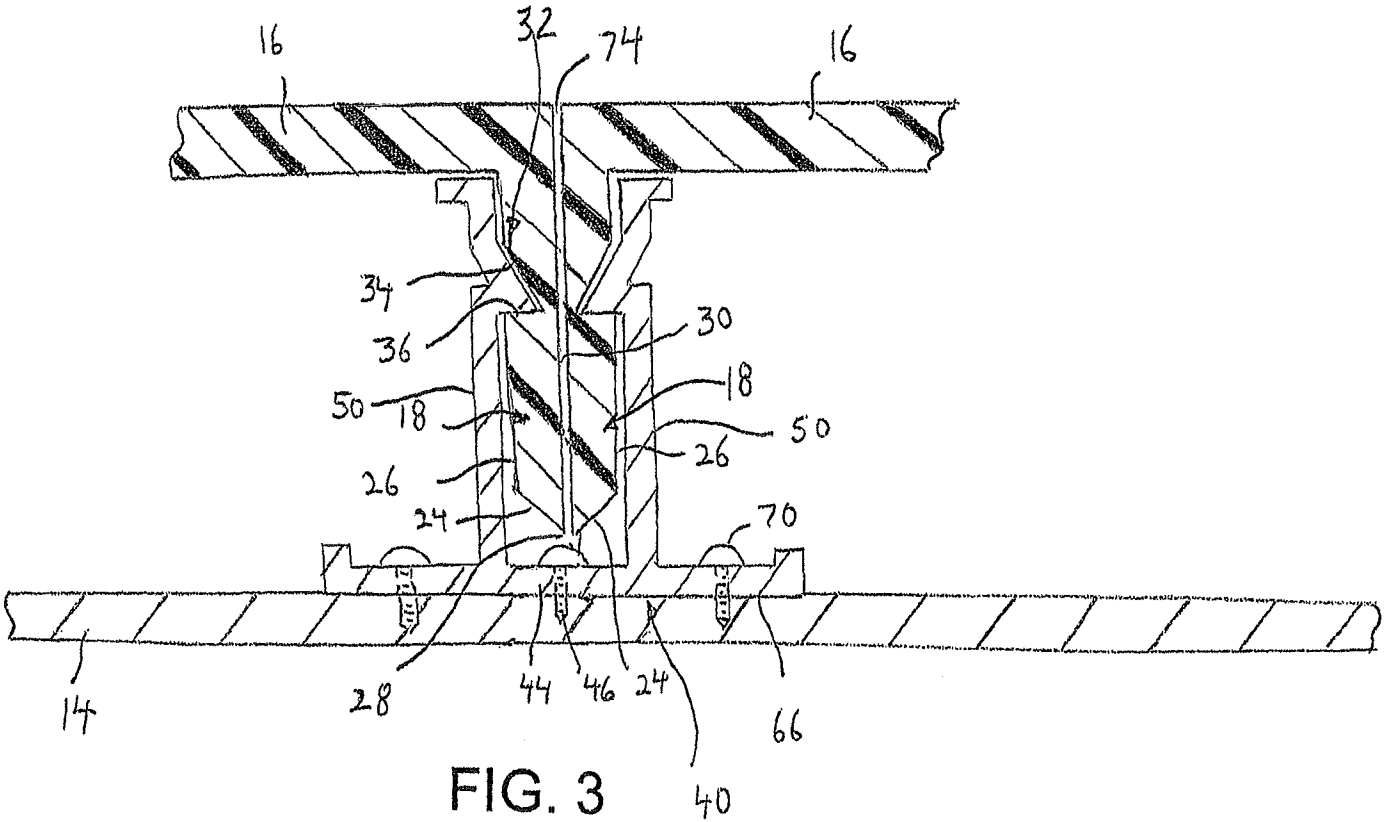
FIG. 3 is a cross-sectional view showing two wall panels connected together by the frame extrusion of FIG. 2.

As shown in FIGS. 2 and 3, main fastening extrusions 38 are provided for securing each wall panel 12 to existing wall structure 14. Each main fastening extrusion 38 is preferably formed as a single, one-piece, unitary member that includes a base section 40 secured to existing wall structure 14 and a supporting section 42 that connects to a side edge of each panel 12. As with each panel 12, each main fastening extrusion 32 is formed preferably by, but not limited to, a polyethylene core 28 with a thin aluminum wall 30 covering opposite sides thereof. More preferably, each main fastening extrusion 12 is formed by polyvinyl chloride (PVC), aluminum or any other deformable and resilient material. However, for the sake of simplicity in the drawings, FIGS. 2 and 4 show main fastening extrusions 38 formed of only a single material.

Base section 40 includes a central planar wall 44 that seats flush against existing wall structure 14, and which has a plurality of linearly aligned openings 46 extending therealong and through which screws 48 can be inserted to secure central wall panel 44 to existing wall structure 14. Two, parallel, spaced apart, bent end securing walls 50 extend outwardly at right angles from opposite ends of central planar wall 44 for securing bent end sections 18 of two adjacent wall panels 12 thereto. As will be understood from the discussion hereafter, bent end securing walls 50 are flexible and resilient, so that they can be bent away from each other and when the bending force is removed, return to their original positions shown in FIGS. 2 and 3.

Each bent end securing wall 50 includes an inwardly directed projection 52 at the inner surface 54 of the respective bent end securing wall 50, with each projection having a nose-shaped configuration in cross-section, which corresponds in shape and dimensions to nose-shaped cut-out section 32, although the present invention is not limited thereby. Specifically, each projection 52 has an inclined surface 56 that slopes in a direction toward base section 40 and terminates at a holding surface 58 that extends parallel to central planar wall 44. Projection 52 preferably extends along the entire length of the bent end securing wall 50, although the present invention is not so limited, that is, projection 52 can extend along only a part of the length of bent end securing wall 50, or there may be a plurality of spaced apart projections 52.

As shown in FIGS. 2 and 3, the outer surface 60 of each bent end securing wall 50 includes a nose-shaped cut-out section 62 corresponding in position to nose-shaped projection 52, in order to save material, although the present invention is not limited thereby, and nose-shaped cut-out section 62 can be eliminated.

The upper free end of each bent end securing wall 50 includes an outwardly extending stub wall 64 that is perpendicular to the respective bent end securing wall 50 and parallel to central planar wall 44.

In addition, although not essential to the present invention, two outwardly extending wing walls 66 extend outwardly from opposite ends of central planar wall 44, that is, outwardly and extending from opposite sides of the lower ends of bent end securing walls 50. Each wing wall 66 is coplanar with central planar wall 44 so as to lie flush against existing wall structure 14, and each wing wall 66 includes a plurality of linearly aligned openings 68 extending therealong and through which screws 70 can be inserted to secure central wall panel wing walls 66 to existing wall structure 14. This provides additional securement of main fastening extrusions 38 to existing wall structure 14. Each wing wall 66 terminates in a bent end stub wall 72, although the present invention is not limited thereby.

With this arrangement, main extrusions 38 are secured to existing wall structure 14 by screws 46 and 70 at predetermined spacing intervals determined by the dimensions of wall panels 12. Thereafter, it is only necessary to push bent end sections 18 of wall panels 12 into the gap between spaced apart bent end securing walls 50. This can be performed with bent end section 18 of one wall panel 12, followed by a bent end section 18 of an adjacent wall panel 12, or with the two bent ends sections 18 of adjacent wall panels 12 simultaneously. In such case, lower beveled surface 24 of each bent end securing wall 50 first hits against inclined surface 56 and biases the respective bent end securing wall 50 outwardly away from the other bent end securing wall 50, whereby the distal end of each bent end section 18 can pass into the space between central planar wall 44 and inwardly directed projection 52. Once holding surface 36 passes holding surface 58, the respective bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel sections 16.

An important aspect of the present invention is that the outer surfaces 30 of adjacent bent end sections 18 are in abutting or near abutting relation, that is, they are at least in near abutting relation. As shown in FIG. 3, there is only a very small gap between adjacent outer surfaces so that they are in near abutting relation, but in fact, they can be, and preferably are, in abutting or touching relation with each other. In other words, the gap 74 between the adjacent outer surfaces 30 is so small that it does not permit bent end sections to be pulled out. With this arrangement, there is no need to provide any sealants or plugs in gap 74, and in fact, no such sealants or plugs would even fit within gap 74.

In other words, the two bent end securing walls 50 have a spacing therebetween corresponding substantially to the wall thickness of the two bent end sections 18 held therein.

In this regard, it is very easy to assemble wall panels 12 by merely pressing bent end sections 18 into the space between adjacent bent end securing walls 50.

As shown in FIG. 4, at a corner of existing wall structure 14, corner fastening extrusions 76 are provided, which merely constitute one-half of a main fastening extrusion 38. Thus, each corner fastening extrusion 76 includes one-half of base section 40, and one wing wall 66 having openings 68, and with only one bent end securing wall 50 having an inwardly directed nose-shaped projection 52 formed by inclined surface 56 at the inner surface 54 thereof and terminating in holding surface 58, along with outwardly extending stub wall 64 at the free end thereof.

During assembly at each corner, a first corner fastening extrusion 76 is secured to one wall **14*a* of existing wall structure 14 by screws 70 extending through openings 68 of the wing 66, such that the free end of base section 40 is in abutting relation to the other wall 14*b* of the corner which is perpendicular to wall 14*a*. In this arrangement, there is a space between the bent end securing wall 50 thereof and the parallel other wall 14*b*. A bent end section 18 is then press fit into this space, whereby the bent end securing wall 50 is biased away from the other wall 14*b*, until holding surface 36 passes by holding surface 58, whereupon bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel section 16**.

In this position, the outer surface 30 of the bent end section 18 is in abutting or near abutting relation with the adjacent corner wall 14*b*, that is, it is at least in near abutting relation.

Then, a second corner fastening extrusion 76 is secured to the other wall 14*b* of existing wall structure 14 by screws 70 extending through openings 68 of the wing 66, such that the free end of base section 40 is in abutting relation to planar main panel section 16 of the already assembled wall panel 12. In this arrangement, there is a space between the bent end securing wall 50 thereof and planar main panel section 16 of the already assembled wall panel 12. A bent end section 18 of another wall panel 12 is then press fit into this space, whereby the bent end securing wall 50 is biased away from planar main panel section 16 of the already assembled wall panel 12, until holding surface 36 passes by holding surface 58, whereupon bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel section 16.

In this position, the outer surface 30 of the bent end section 18 is in abutting or near abutting relation with the adjacent planar main panel section 16, that is, it is at least in near abutting relation.

It will be appreciated that the present invention can be varied within the scope of the claims. In all of the following embodiments, the bend end securing walls 50 are biased outwardly when the bend end sections 18 are pressed into engagement therewith, whereby the bent end sections 18 snap back and are then locked with the bent end securing walls 50.

Figure 6:
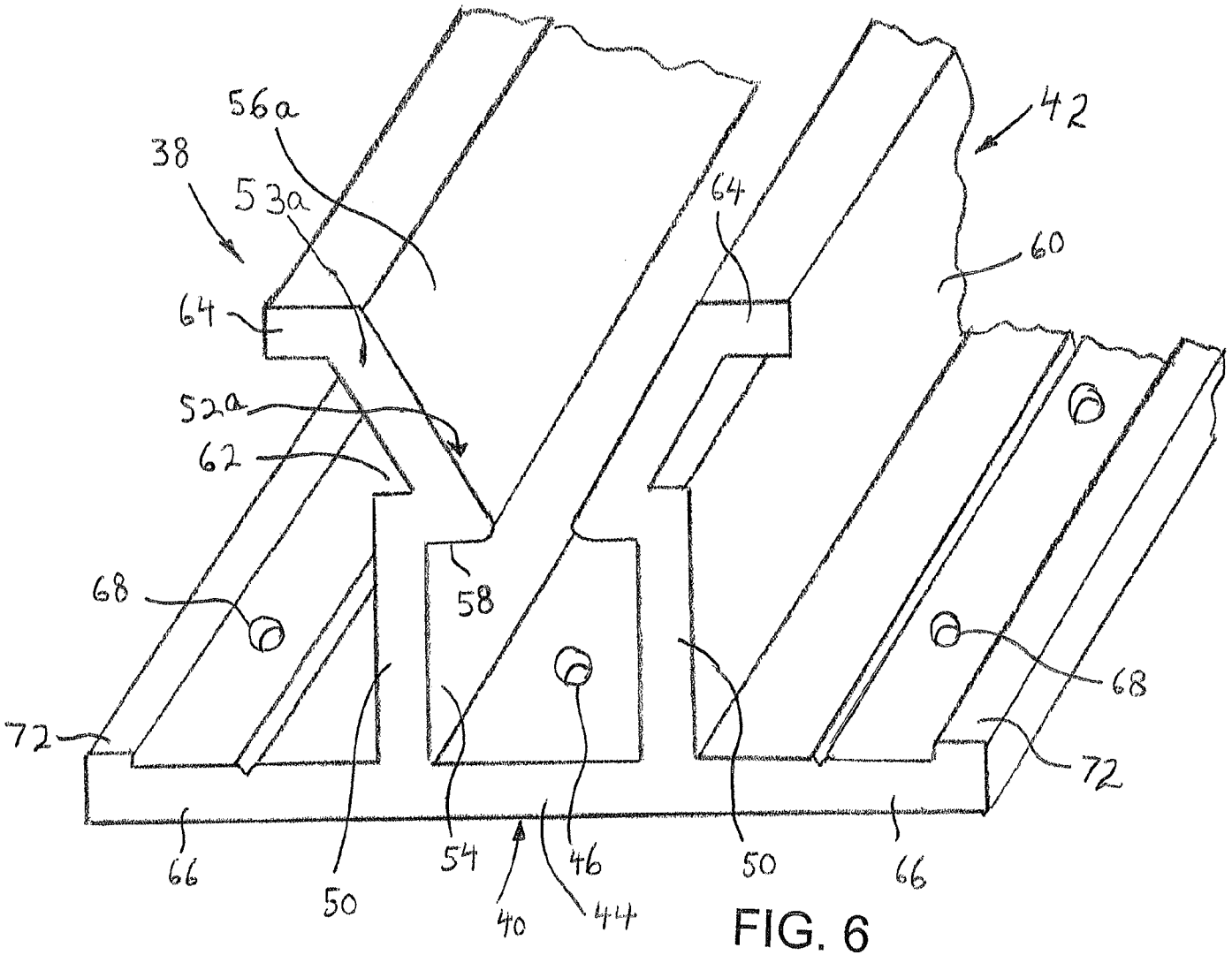
FIG. 6 is a perspective view of a frame extrusion according to another embodiment of the present invention.

Thus, FIG. 6 shows a modification of the embodiment of FIG. 2 in which the inclined surface 56*a* of each inwardly directed projection 52*a* continues upwardly at an angle with an inclined wall 53*a* ends in outwardly extending stub wall 64 that is perpendicular to the respective bent end securing wall 50 and parallel to central planar wall 44, rather than changing direction and running parallel to each bent end securing wall 50. Preferably, although not required, outwardly extending stub wall 64 is in contact with the underside of planar main panel section 16 when inwardly directed projection 52*b* is positioned in cut-out section 32 so as to provide a snap-tight like action with a tight fit so that there is little or no play, whereby wall panels 12 are tightly held in position. This is due to the combination of cut-out section 32 having a holding surface 36 that is substantially parallel to planar main panel section 16 when wall panels 12 are assembled, and the engagement of the stub walls 64 with the underside of planar main panel section 16, which is different from known arrangements which provide arcuate cut-out sections 32.

Of course, it will be appreciated that outwardly extending stub walls 64 can be eliminated, and the free end of inclined wall 53*a* could be used to contact the underside of planar main panel section 16. In either case, stub wall 64 or the free end of inclined wall 53*a* where stub wall 64 is eliminated, it is the free end of bent end section 18 that contacts the underside of planar main panel section 16 to provide the aforementioned tight fit without any play.

Figure 7:
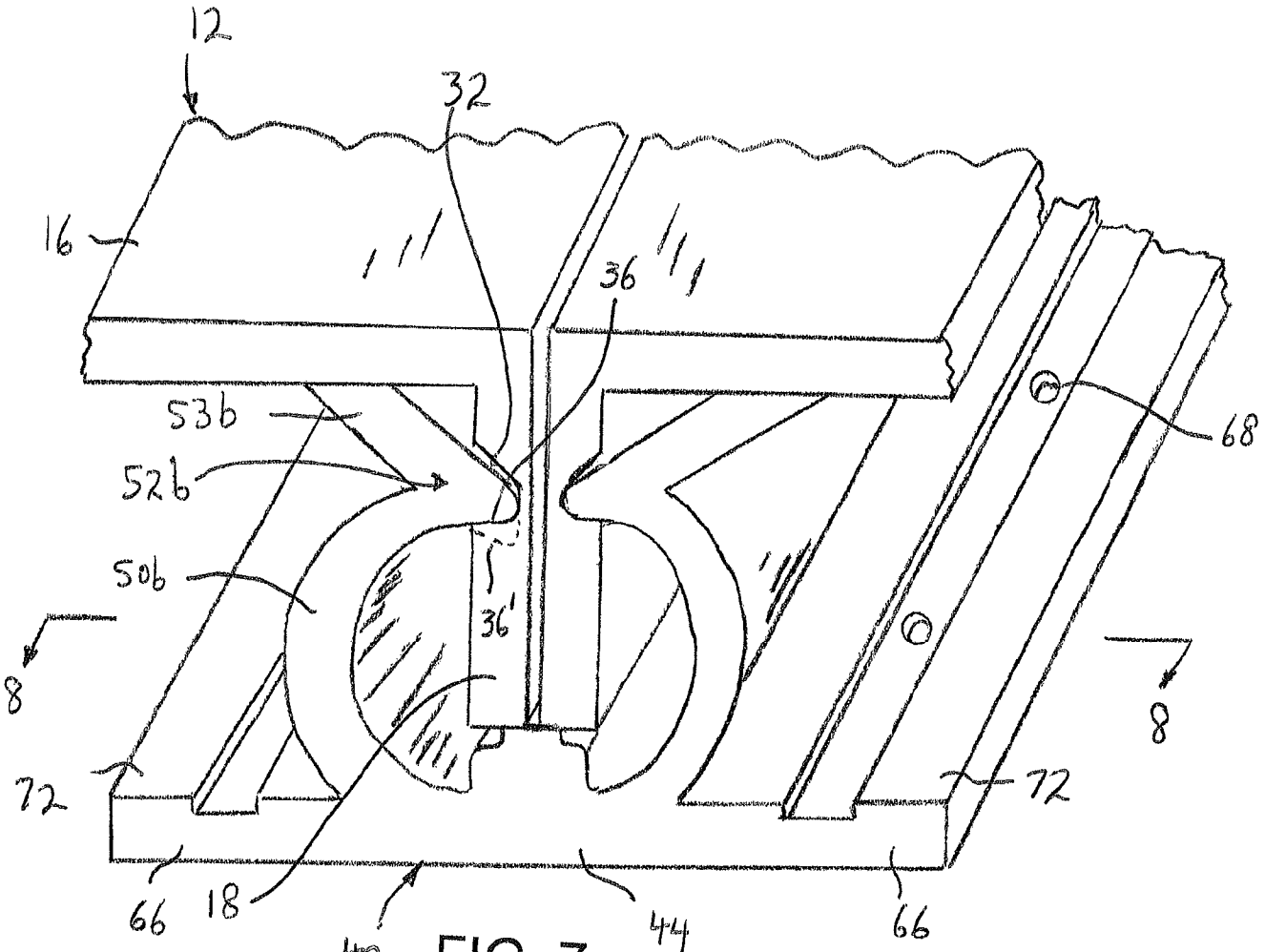
FIG. 7 is a perspective view showing two wall panels connected together by a frame extrusion according to another embodiment of the present invention.
Figure 8:
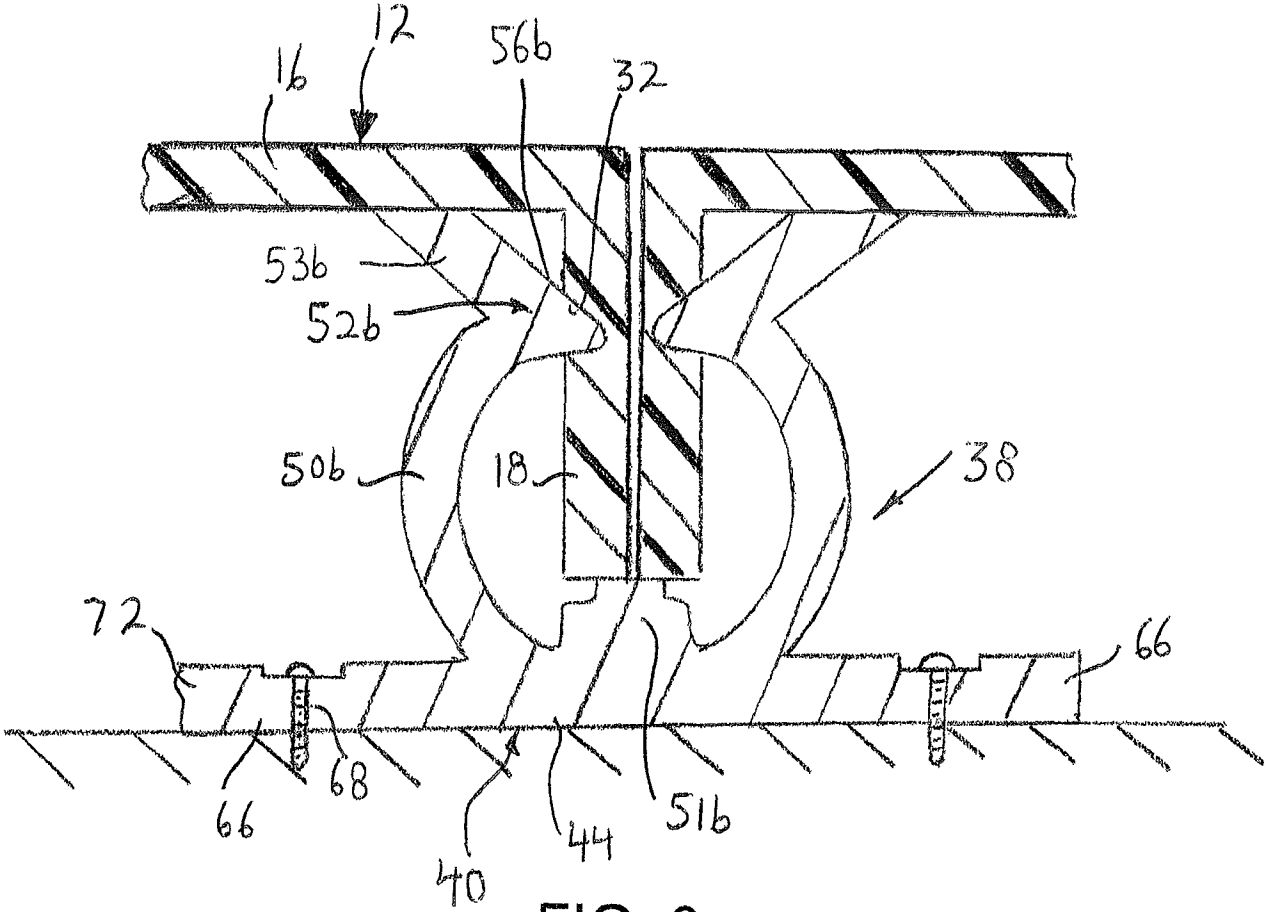
FIG. 8 is a cross-sectional view showing two wall panels connected together by the frame extrusion of FIG. 7.

FIGS. 7 and 8 shows a modification of the FIG. 6 embodiment in which outwardly extending stub walls 64 are eliminated and in which each bent end securing wall 50*b* has an outward curvature, terminating in an inwardly directed projection 52*b*. Further, the inclined surface 56*b* of each inwardly directed projection 52*b* continues upwardly at an angle with an inclined wall 53*b* that abuts against the inner surface or undersurface of planar main panel section 16 since the outwardly extending stub wall is eliminated. As will be understood from the discussion hereafter, bent end securing walls 50*b* are also flexible and resilient, so that they can be bent away from each other and when the bending force is removed, return to their original positions so that inwardly directed projections 52*b* engage in cut-out sections 32 in FIG. 7. In addition, a center platform section 51*b* is provided along the center of base section 40, on which the lower ends of two bent end sections 18 rest. Screws (not shown) can be inserted through center platform section 51*b* to secure the extrusion to the wall.

As will be appreciated from the latter embodiment, the two inwardly directed projections 52*b* have a spacing therebetween which is less than the wall thickness of two said bent end sections 18.

As with the embodiment of FIG. 6, a tight fit is obtained with little play. In both embodiments of FIG. 6 and FIGS. 7 and 8, and contrary to known arrangements, holding surface 36 would be substantially parallel to planar main panel section 16 when wall panels 12 are assembled. However, it is possible that the holding surface is angled in a direction away from the respective main panel section, 16 starting from inner surface 26 of bent end section 18, as shown by dashed line holding surface 36' in FIG. 7. Of course, in the latter situation, holding surface 58 of inwardly directed projection 52 would have a similar slope.

Figure 9:
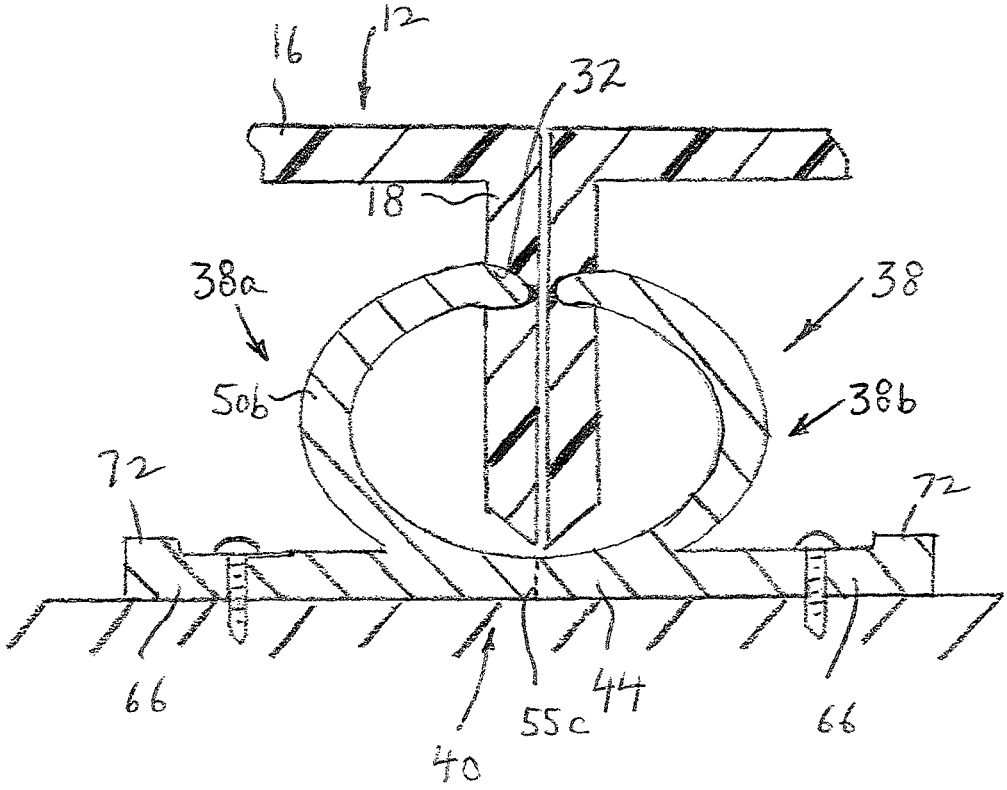
FIG. 9 is a cross-sectional view showing two wall panels connected together by a frame extrusion according to another embodiment of the present invention.

FIG. 9 shows a modification of the FIG. 7 embodiment in which platform 51*b* and inclined walls 53*b* are eliminated. In addition, as with all of the embodiments in the present application, main fastening extrusions 38 can each be formed as a unitary, one piece structure or of two separate main fastening extrusion sections 38*a* and 38*b* divided, as shown, by dashed line 55*c* in FIG. 9.

Figure 10:
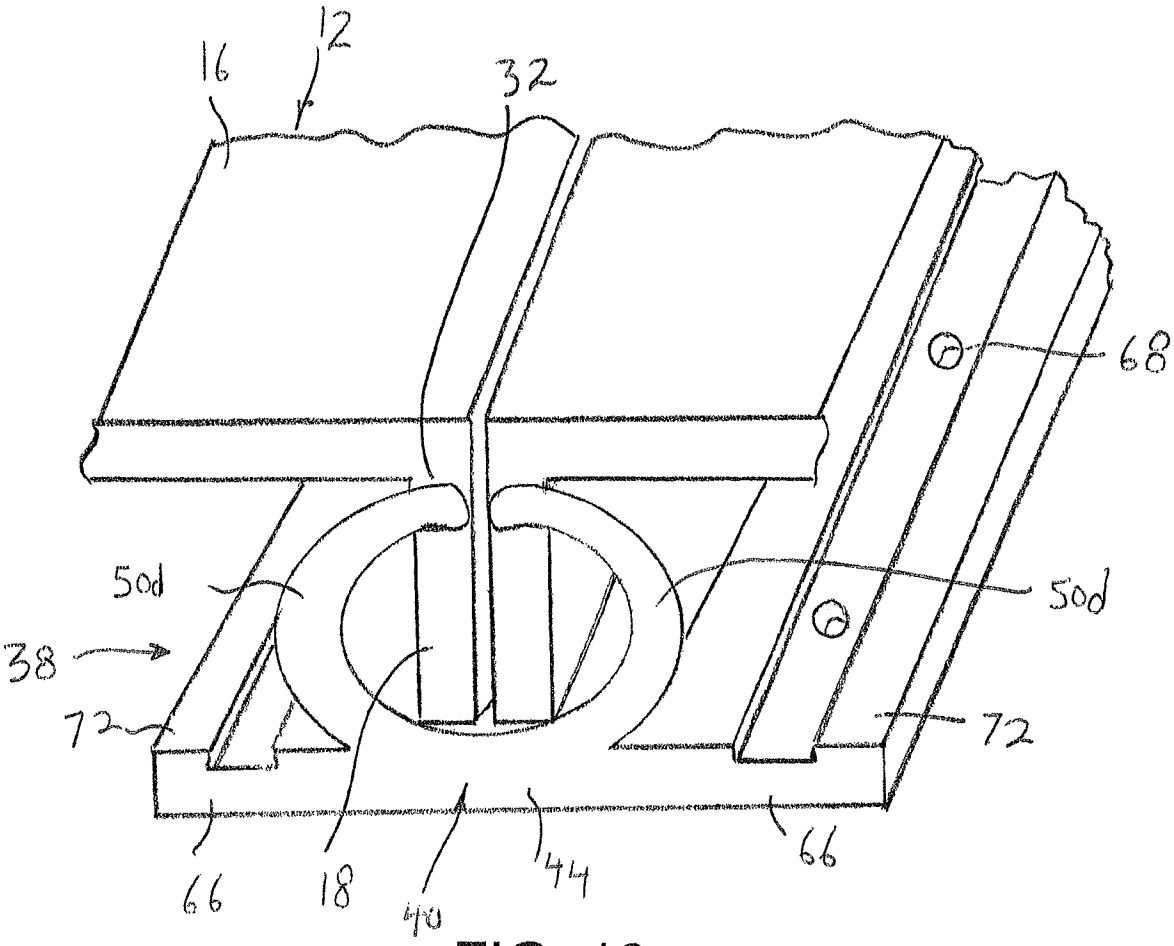
FIG. 10 is a perspective view showing two wall panels connected together by a frame extrusion according to another embodiment of the present invention.

FIG. 10 shows a modification of the FIG. 9 embodiment in which the only change has been changing the arc of outwardly curved bent end securing walls 50*d* so that the free ends thereof engage in cut-out sections 32 at positions close to the inner surfaces of bent end sections 18.

Figure 11:
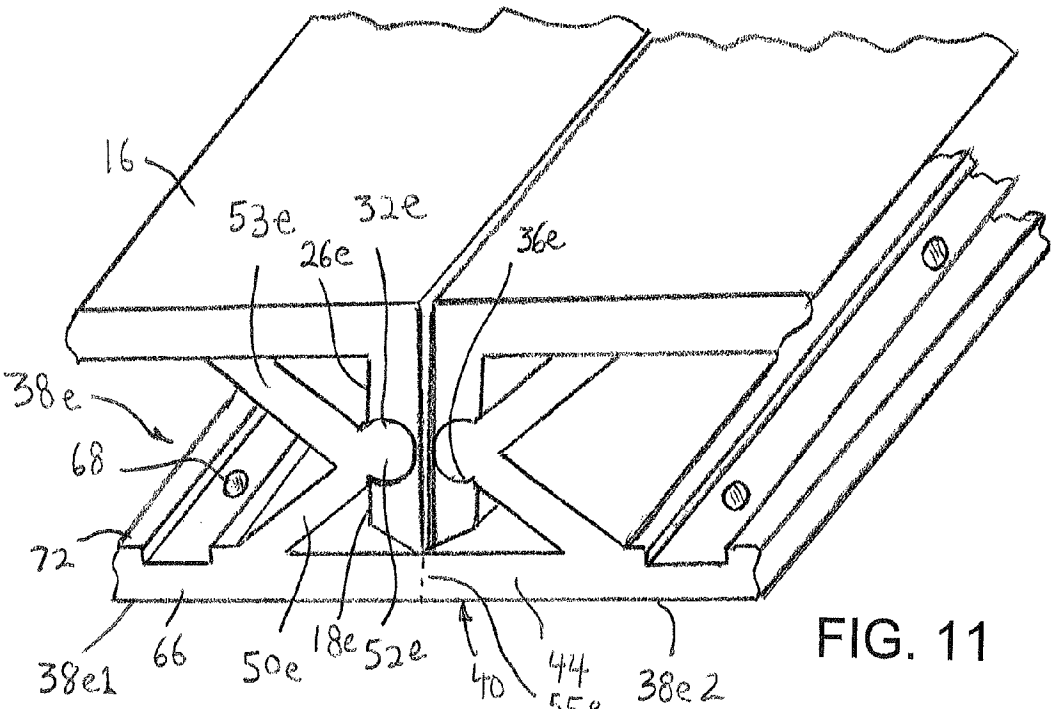
FIG. 11 is a perspective view showing two wall panels connected together by a frame extrusion according to another embodiment of the present invention.

FIG. 11 shows a modification of the FIGS. 7 and 8 embodiment in which the bent end securing walls 50*e* are inclined inwardly in an opposite direction from outwardly inclined walls 53*e* and meet at a cylindrical inwardly directed projection 52*e* which is engaged in a part cylindrical cut-out section 32*e* which has a circumference that extends over an angle greater than 180 degrees. Cylindrical inwardly directed projection 52*e* also has a circumference that extends over an angle greater than 180 degrees and has a diameter similar to the diameter of cylindrical cut-out section 32*e* so that it is force fit and snaps into part cylindrical cut-out section 32*e* in order to lock wall panels 12 and extrusions 38 together. It will be appreciated that, contrary to known arrangements, part cylindrical cut-out section 32*e* and cylindrical inwardly directed projection 52*e* extend over an angle greater than 180 degrees in order to provide this snap fitting arrangement. Of course, because of the snap fitting engagement, inclined wall 53*e* can be eliminated, although it is preferable to include inclined wall 53*a* for purposes of stability of the structural arrangement.

With this embodiment, pressing of bent end sections 18*e* into the spacing between bent end securing walls 50*e* causes bent end securing walls 50*e* to be biased away from each other until projections 52*e* snap engage into respective cut-out sections 32*e* to lock bent end sections 18*e* in the spacing in a manner that outer walls of bent end sections 18*e* are at least in near abutting relation with each other. It will be appreciated, however, that the spacing between bent end sections 18*e* can be much greater such that bent end securing walls 50*e* need not be biased. This is because of the snap fitting relation of projections 52*e* into part cylindrical cut-out sections 32*e*. In the latter case, bent end securing walls 50*e* need not be biased outwardly.

Further, it will be appreciated that, because part cylindrical cut-out section 32*e* extends over an angle greater than 180 degrees, part cylindrical cut-out section 32*e* defines a holding surface 36*e* which is slightly inclined at an angle away from said main panel section 16, starting from the inner wall surface 26*e* of the bent end section 18*e*. Therefore, a positive engagement is provided with little or no room for play or movement of wall panels 12.

Figure 12:
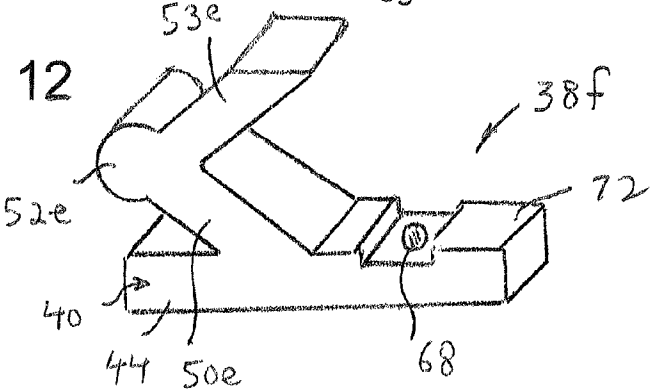
FIG. 12 is a perspective view of a frame extrusion according to another embodiment of the present invention.

As discussed above with respect to FIG. 9, main fastening extrusions 38*e* of FIG. 11 can each be formed as a unitary, one piece structure or of two separate main fastening extrusion sections 38*e*1 and 38*e*2 divided, as shown, by dashed line 55*c* in FIG. 9. In addition, each separate main fastening extrusion section 38*e*1 and 38*e*2 can be formed from a plurality of discrete main fastening extrusions 38*f*, as shown in FIG. 12, which are secured to the wall in parallel, spaced apart relation to each other. This applies to all of the embodiments of the present application.

Figure 13:
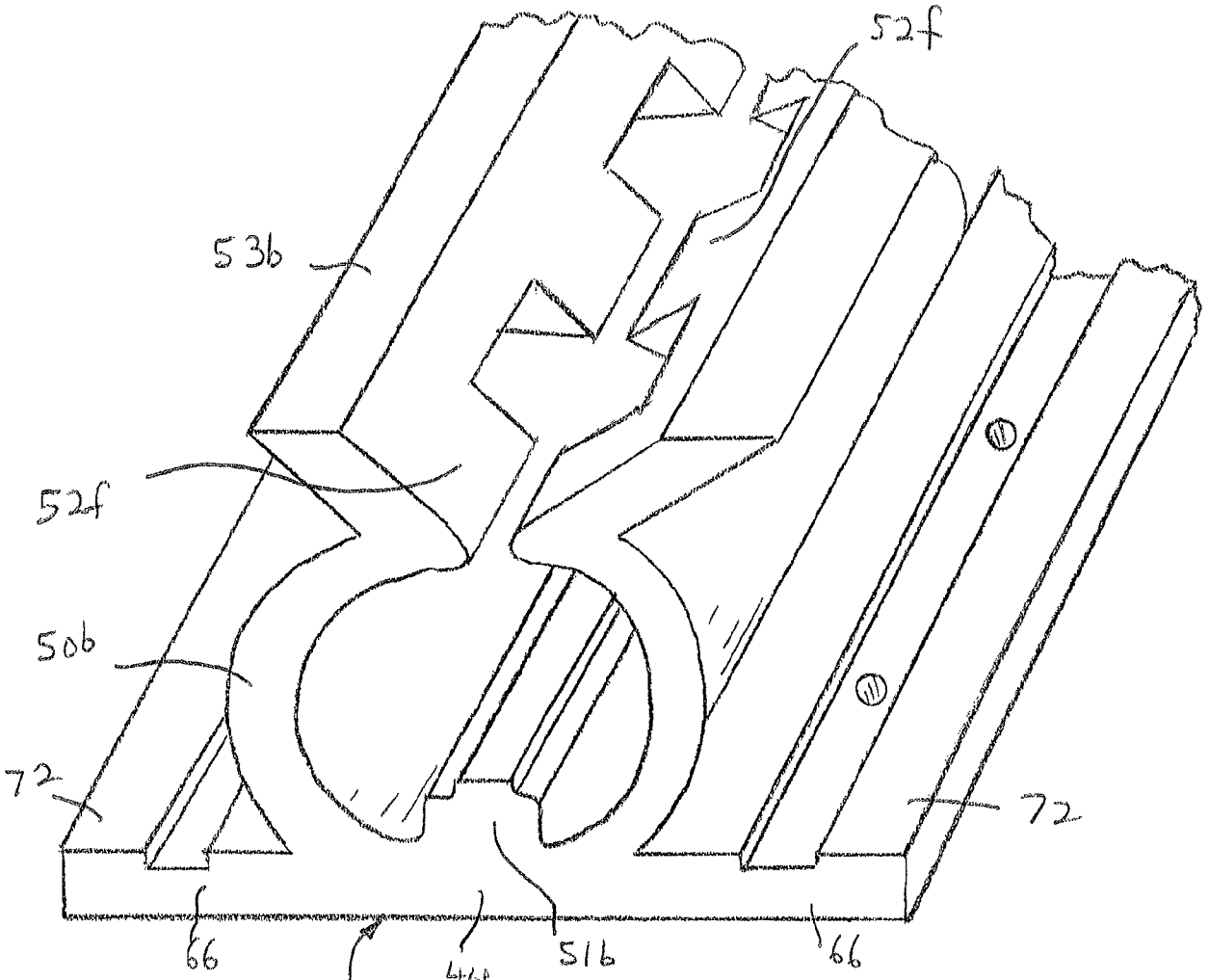
FIG. 13 is a perspective view of a frame extrusion according to another embodiment of the present invention.

It will be appreciated that, with the above embodiments, the respective cut-out section 32 has been continuous. However, it is possible that a plurality of spaced apart cut-out sections 12 can be provided along the length of bent end sections 18, and in such case, each inwardly directed projection 52 would be formed of a plurality of spaced apart inwardly directed teeth 52*f*, as shown in FIG. 13, which is a variation of the embodiment of FIGS. 7 and 8. This applies to all of the embodiments in the present application.

As discussed above, U.S. Pat. No. 4,344,267 to Sukolics, U.S. Pat. No. 4,829,740 to Hutchison and U.S. Pat. No. 5,809,729 to Mitchell, provide a wall system with L-shaped ends of the panels that include recesses in the bent ends that engage with projections of the extrusions secured by screws to the walls, in which there is a large gap between adjacent bent ends. The present invention provides further advances over these systems.

Figure 14:
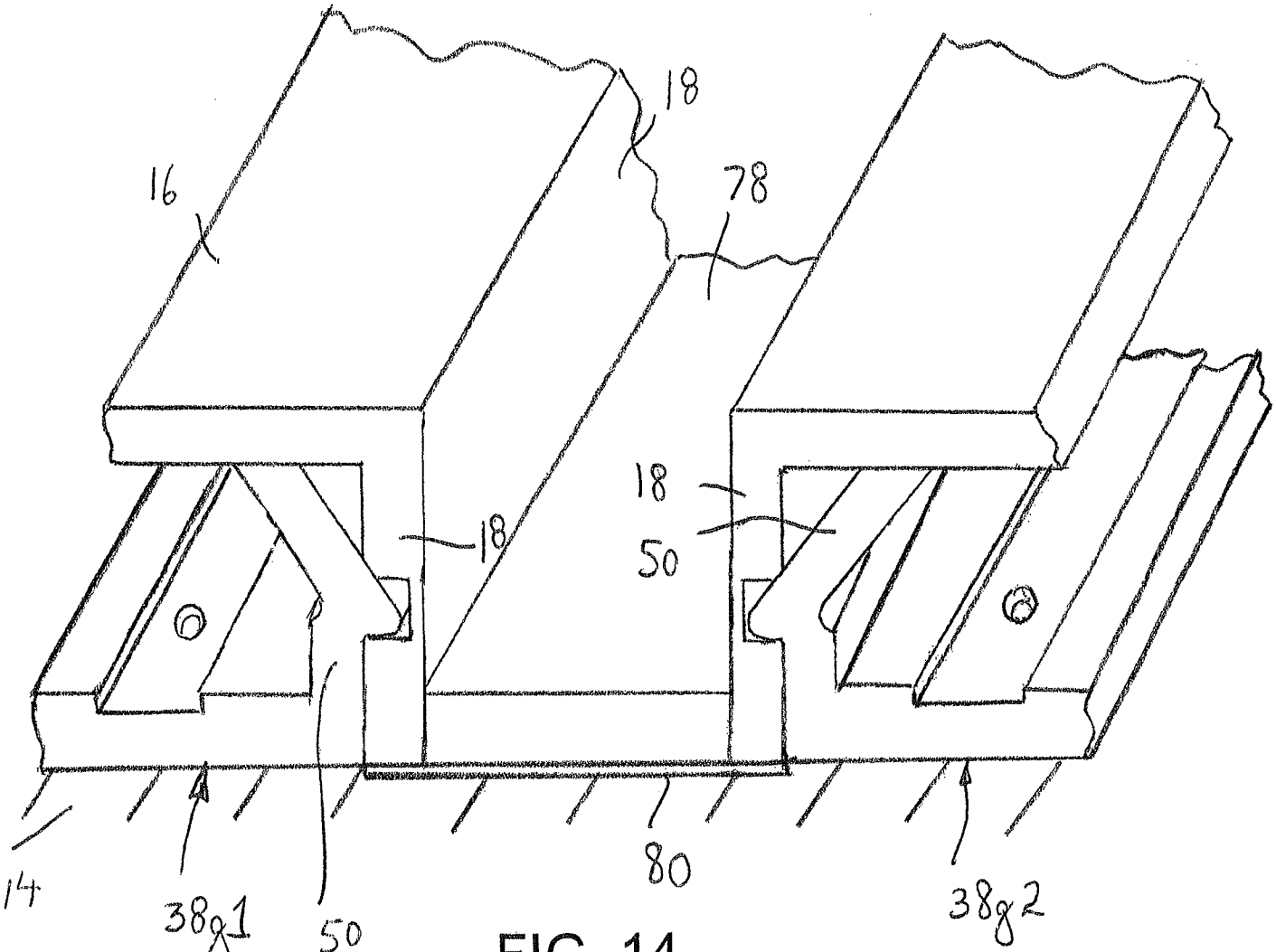
FIG. 14 is a perspective view showing two wall panels connected together by a frame extrusion according to another embodiment of the present invention.

Specifically, as shown in FIGS. 14-16, two separate main fastening extrusion sections 38*g*1 and 38*g*2 are provided, which are of a similar configuration to the main fastening extrusion of FIG. 6, divided along a center line. In the embodiment of FIG. 14, a further spacer member 78 in the shape of a rectangular parallelepiped is first secured to the wall 14 by a double sided adhesive strip 80. Then, separate main fastening extrusion sections 38*g*1 and 38*g*2 are secured to wall 14 by screws, such that the inner surfaces of bent end securing walls 50 thereof are spaced away from the side edges of spacer member 78 by a distance equal substantially to the thickness of a bent end section 18.

Figure 17:
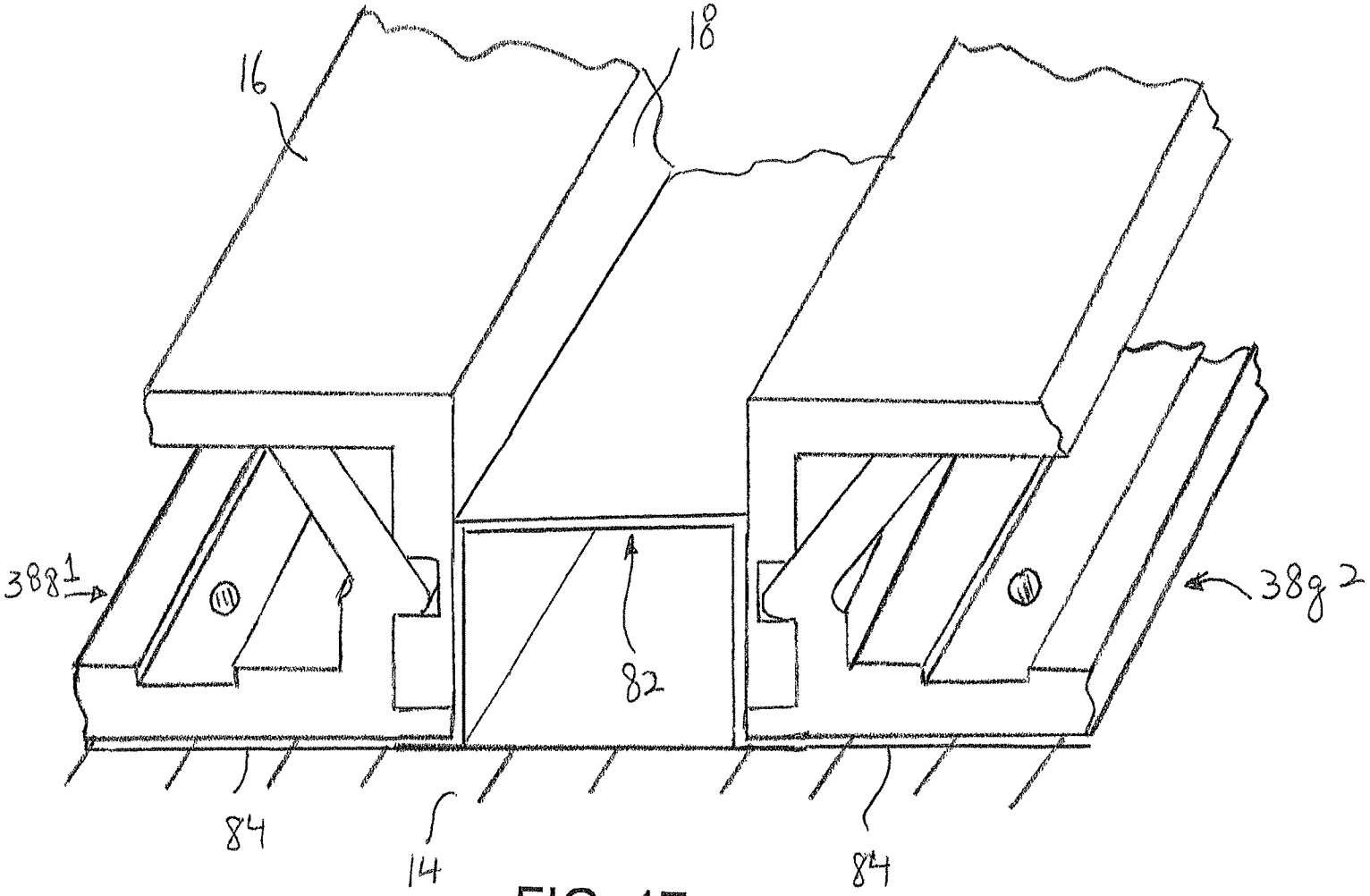
FIG. 17 is a perspective view showing two wall panels connected together by a frame extrusion according to another embodiment of the present invention.

Alternatively, as shown in FIG. 17, a thin walled, inverted U-shaped spacer member 82 is provided in place of spacer member 78 for the same purpose, with U-shaped spacer member 82 including outwardly extending wing sections 84 that extend between separate main fastening extrusion sections 38*g*1 and 38*g*2 and wall 14.

Figure 17A:
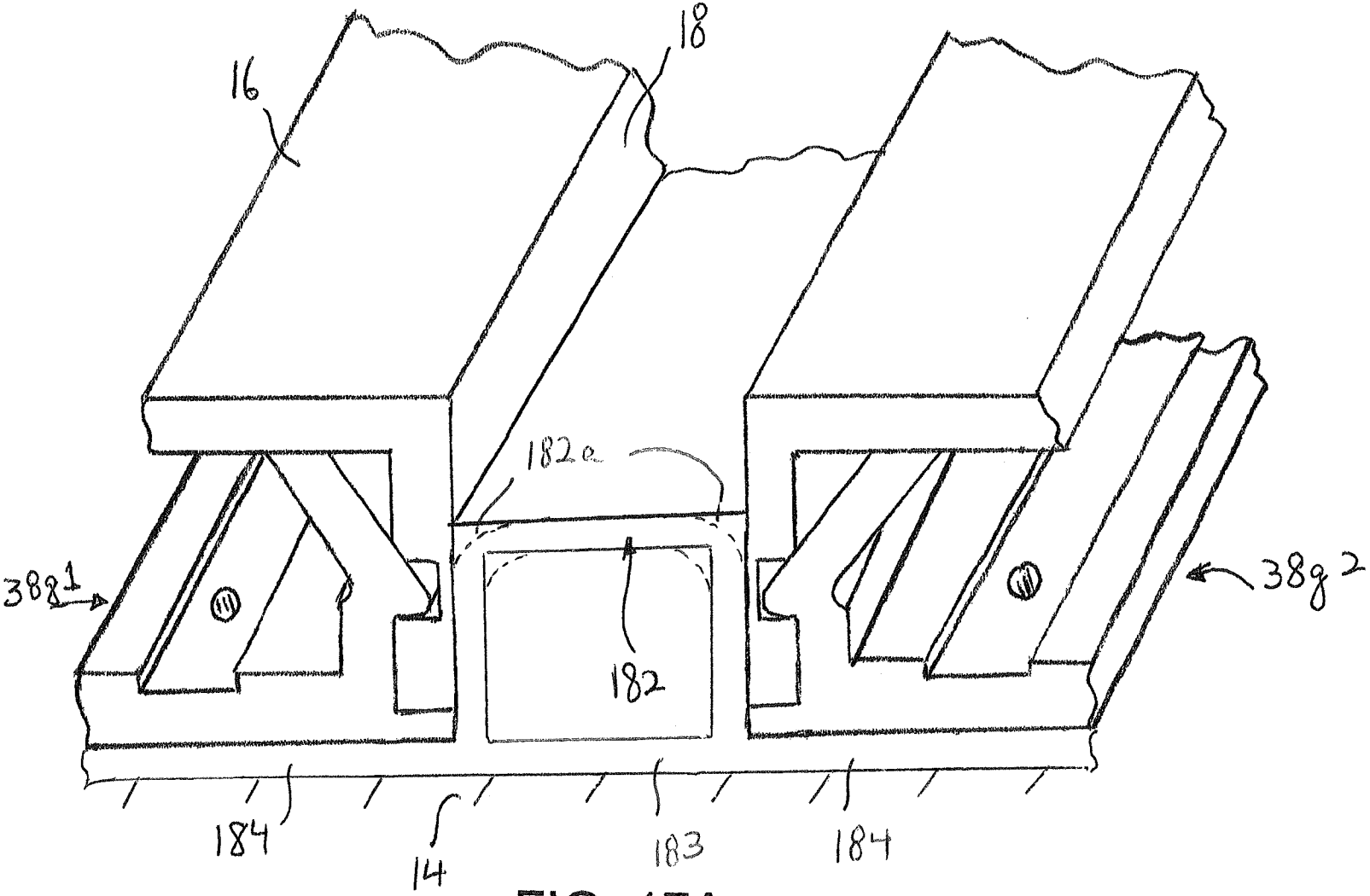
FIG. 17A is a perspective view showing two wall panels connected together by a frame extrusion which is the same as FIG. 17, but with a modified spacer member.

FIG. 17A shows a modified spacer member 182 with U-shaped spacer member 182 and outwardly extending wing sections 184 being of a greater thickness than corresponding elements 82 and 84 of FIG. 17. In addition, there is a central connecting section 183 between wing sections 184. As shown by dashed lines in FIG. 17A, the upper corners 182*a* of U-shaped spacer member 182 can be curved or arcuate.

Figure 17B:
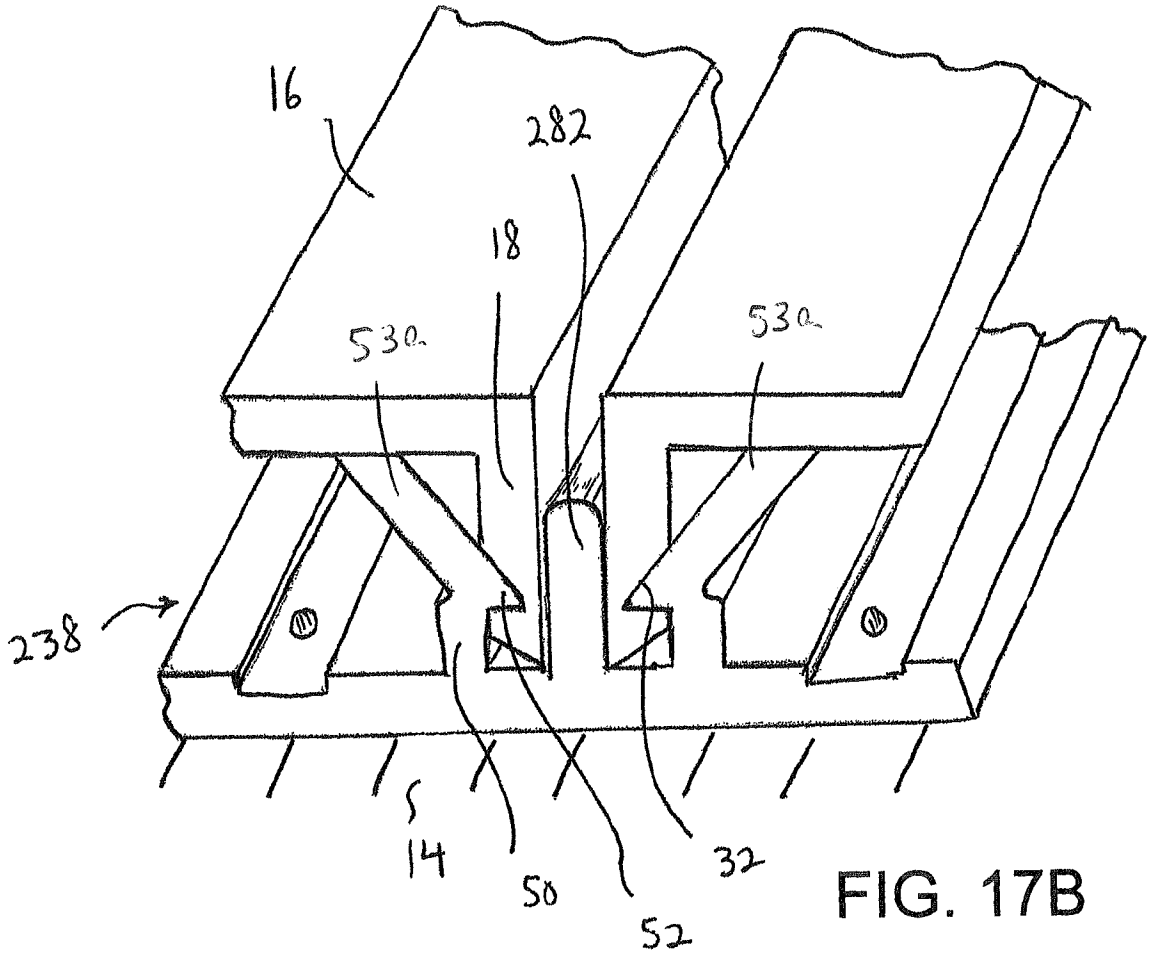
FIG. 17B is a perspective view showing a main fastening extrusion similar to FIG. 17, except that the U-shaped spacer member is replaced by a spacer post member.

FIG. 17B shows an embodiment similar to FIG. 17, except that U-shaped spacer member 82 is replaced by a spacer post member 282 that is formed integrally as a single piece with main fastening extrusion 238. Thus, each bent end section 18 of a wall panel 12 is fit between a respective bent end securing wall 50 and spacer post member 282.

Figure 17C:
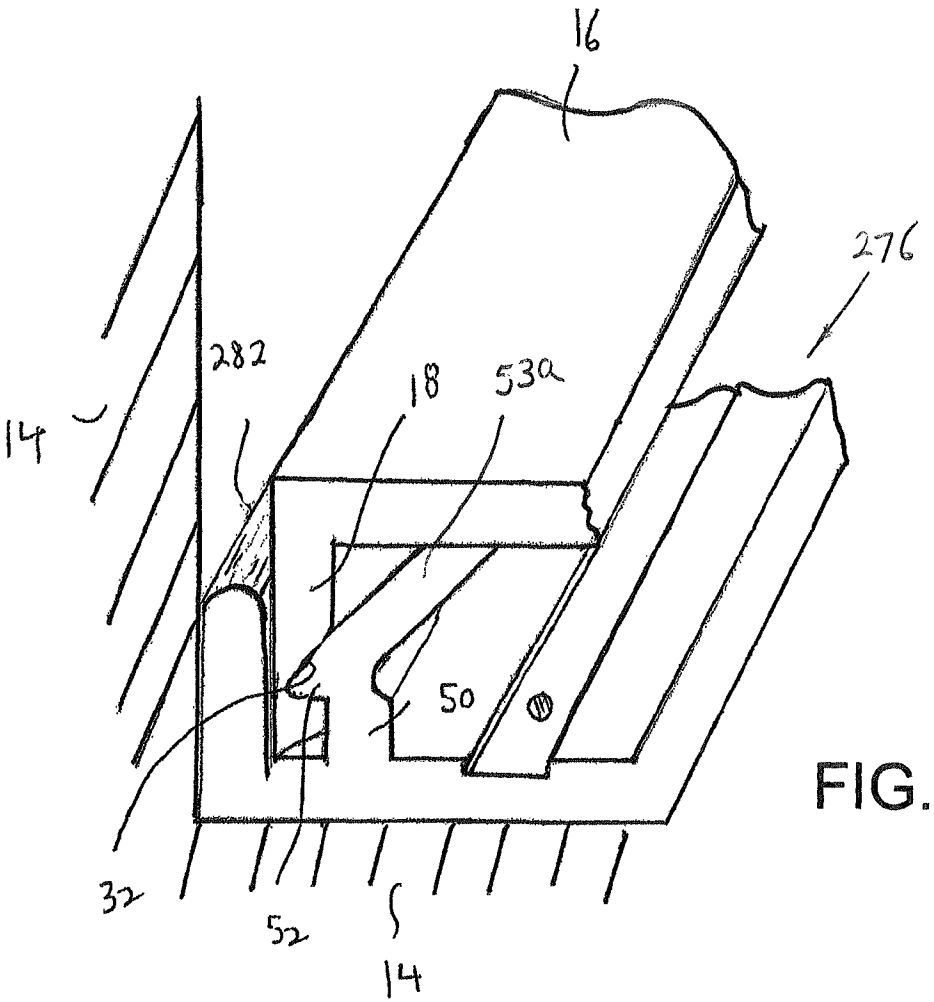
FIG. 17C is a perspective view showing a corner fastening extrusion corresponding to the main fastening extrusion of FIG. 17B.

FIG. 17C shows a corner fastening extrusion 276 corresponding to main fastening extrusion 238 in which spacer post member 282 is positioned flush against the existing wall structure 14.

Figure 17D:
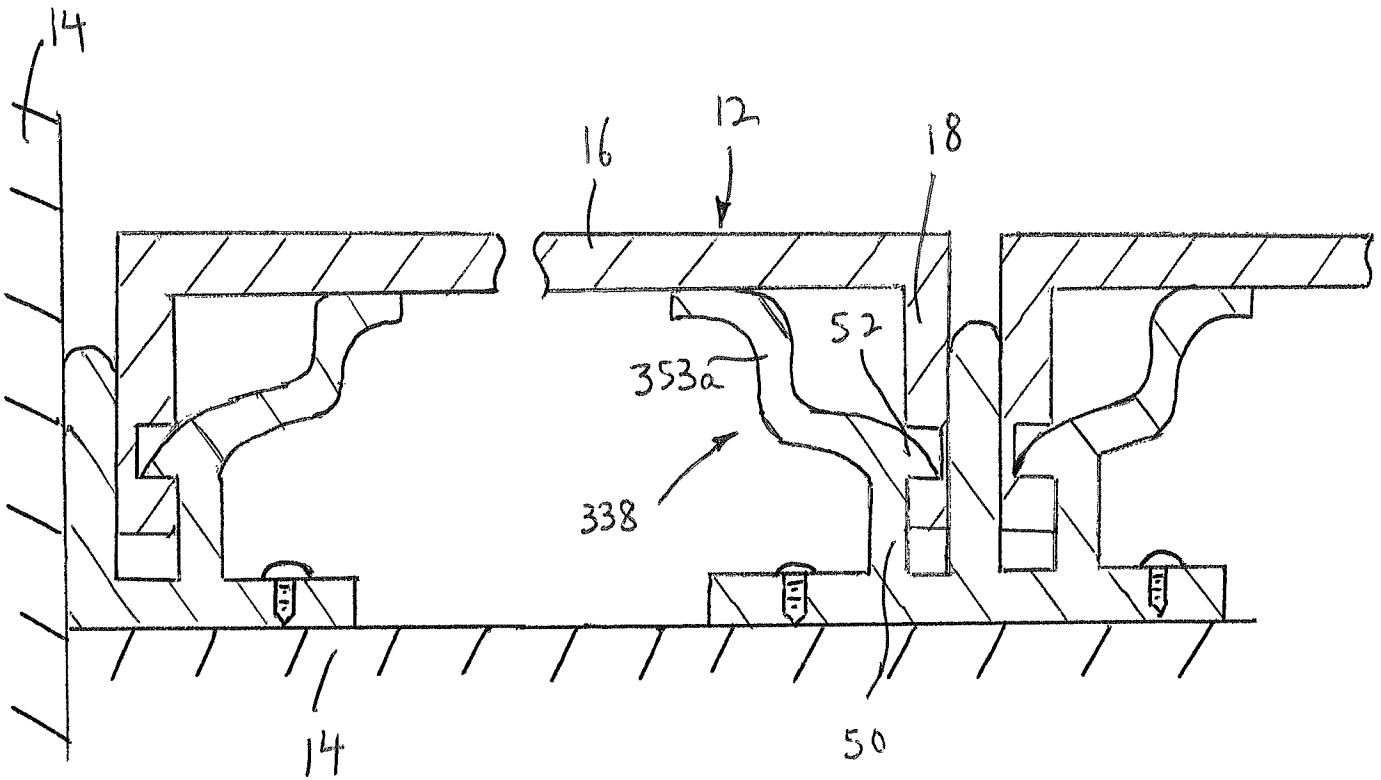
FIG. 17D is a cross-sectional view of a modified main fastening extrusion and corner fastening extrusion.

FIG. 17D shows a modified main fastening extrusion 338 and correspondingly modified corner fastening extrusion 376 from those shown in FIGS. 17B and 17C, in which the only difference is that inclined wall 53*a* of main fastening extrusion 238 and correspondingly modified corner fastening extrusion 276 are replaced by S-shaped walls 353*a* extending at about a 45 degree angle, with the free ends thereof contacting main panel section 16.

Figure 17E:
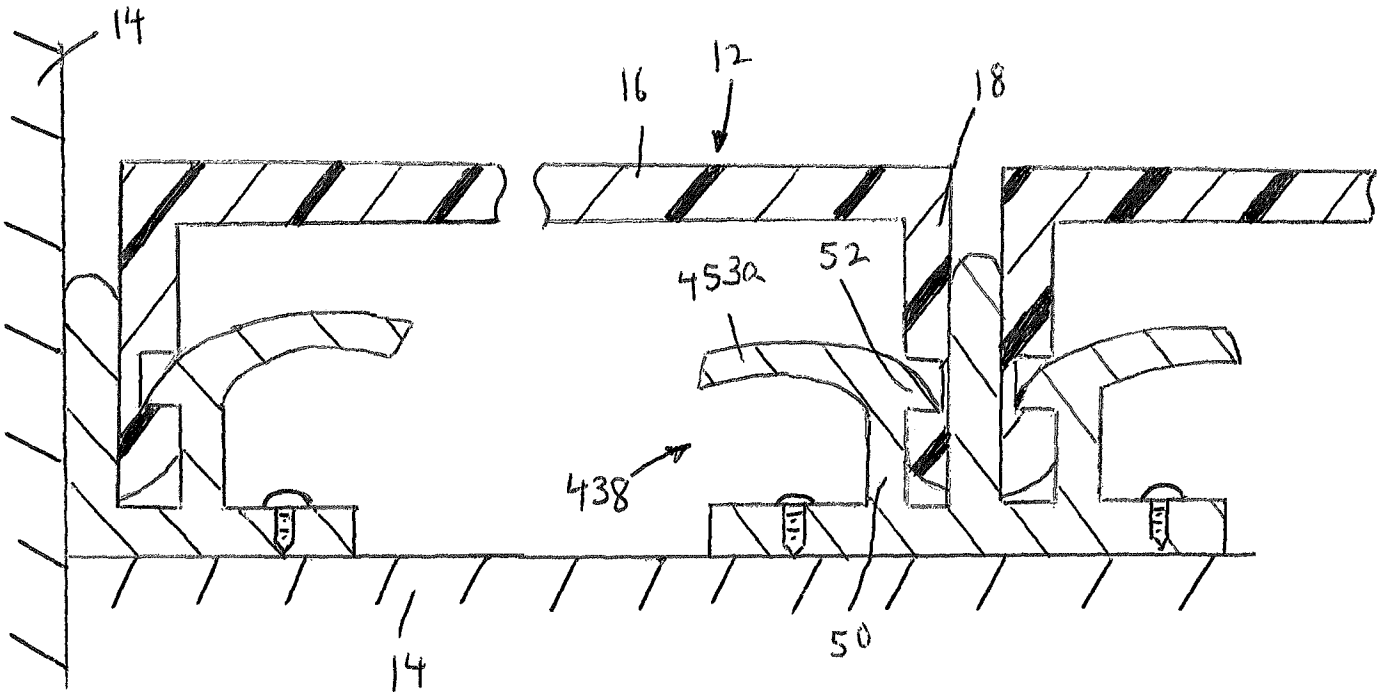
FIG. 17E is a cross-sectional view of a modified main fastening extrusion and corner fastening extrusion.

FIG. 17E shows a modified main fastening extrusion 438 and correspondingly modified corner fastening extrusion 476 from those shown in FIGS. 17B and 17C, in which the only difference is that inclined wall 53*a* of main fastening extrusion 238 and correspondingly modified corner fastening extrusion 276 are replaced by slightly arcuate walls 453*a* which do not contact main panel section 16.

Figure 17F:
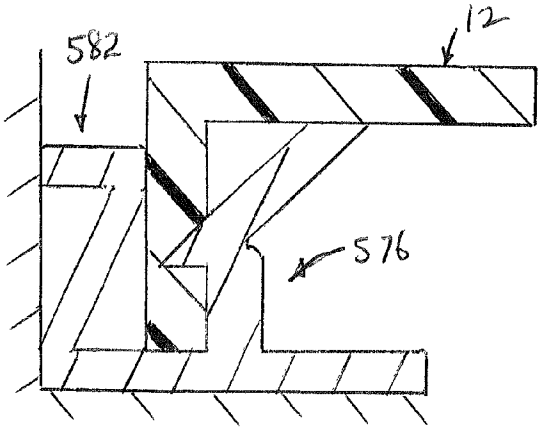
FIG. 17F is a cross-sectional view of a modified corner fastening extrusion.
Figure 17G:
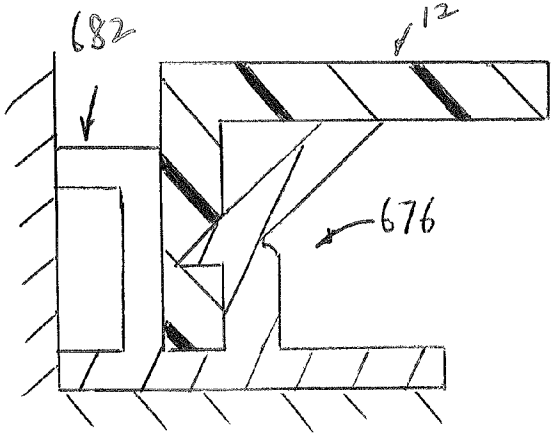
FIG. 17G is a cross-sectional view of a modified corner fastening extrusion.
Figure 17H:
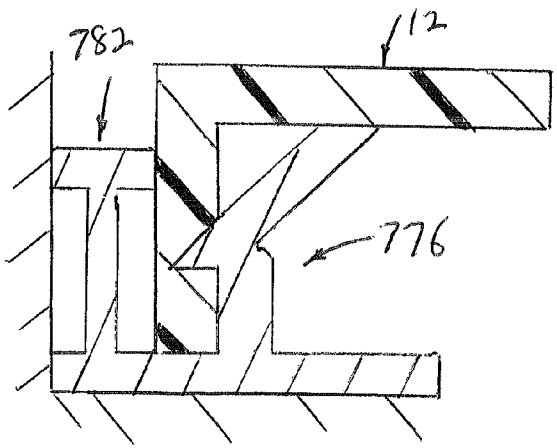
FIG. 17H is a cross-sectional view of a modified corner fastening extrusion.
Figure 17I:
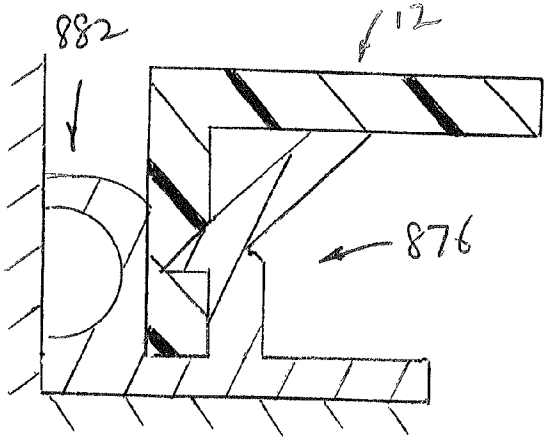
FIG. 17I is a cross-sectional view of a modified corner fastening extrusion.
Figure 18:
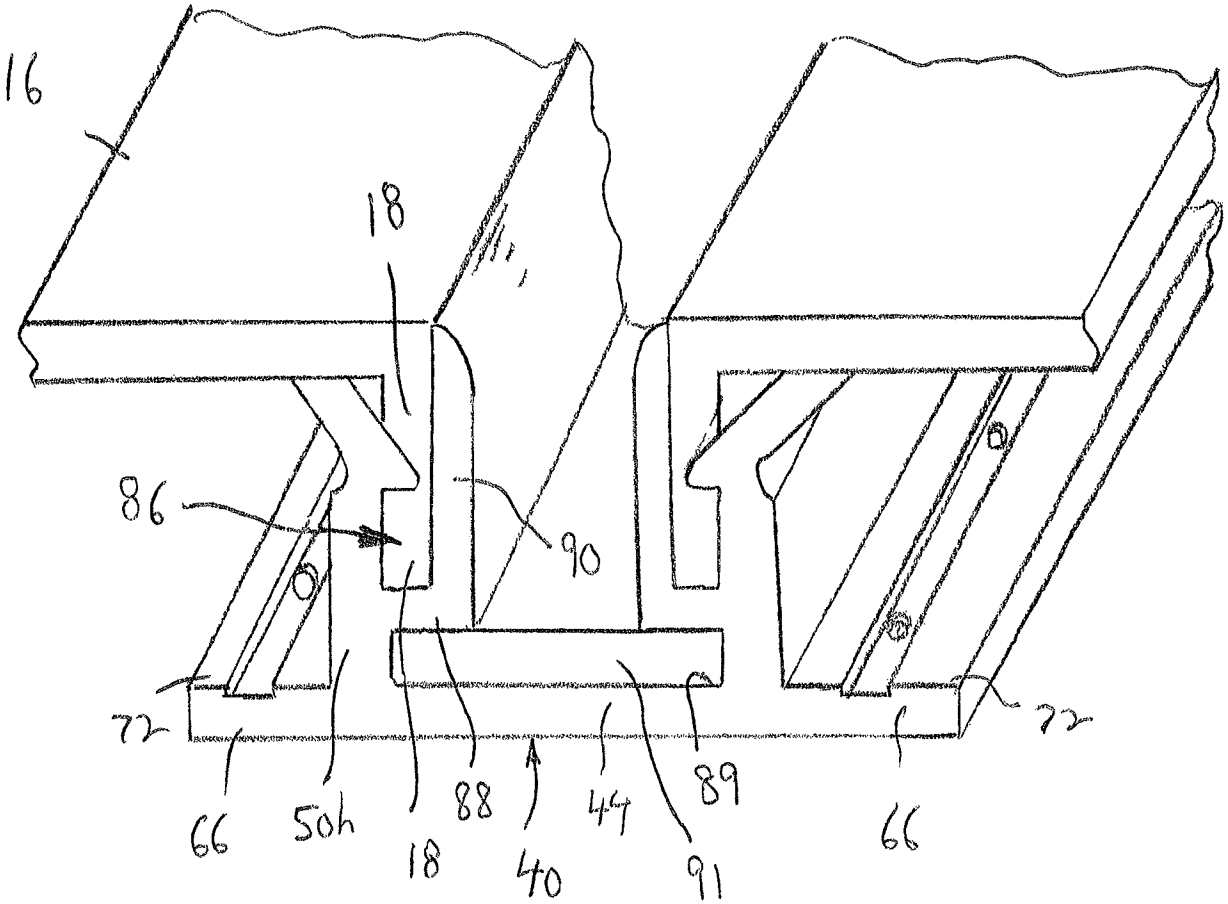
FIG. 18 is a perspective view showing two wall panels connected together by a frame extrusion according to another embodiment of the present invention.

FIG. 17F shows a corner fastening extrusion 576 similar to corner fastening extrusion 276 of FIG. 40, except that post member 282 is replaced with a Z-shaped spacer member 582;

FIG. 17G shows a corner fastening extrusion 676 similar to corner fastening extrusion 276 of FIG. 40, except that post member 282 is replaced with an outwardly facing U-shaped spacer member 682;

FIG. 17H shows a corner fastening extrusion 776 similar to corner fastening extrusion 276 of FIG. 40, except that post member 282 is replaced with an outwardly facing I-shaped spacer member 782;

FIG. 17I shows a corner fastening extrusion 876 similar to corner fastening extrusion 276 of FIG. 40, except that post member 282 is replaced with an outwardly facing C-shaped spacer member 882;

FIG. 18 shows another embodiment which is similar to that of FIG. 6, except that bent end securing walls 50*h* are spaced apart further than that in the embodiment of FIG. 6. With this embodiment, an upwardly extending L-shaped extension 86 extends includes a first leg 88 as a lateral connecting wall that extends inwardly from a lower portion of bent end securing wall 50*h* and a second leg 90 as an inner wall that extends upwardly from the free end of first leg 88 and in parallel spaced apart relation to the respective securing wall 50*h* with a spacing substantially equal to the thickness of a bent end section 18 which fits therein. In this manner, bent end sections 18 are inserted in the gap between a securing wall 50*h* and respective second leg 90. With this arrangement, there is a space 89 between central planar wall 44 and each first leg 88. A closure plate 91 of the same material and structure as wall panel 12 and of a rectangular parallelepiped shape is inserted in spaces 89 and also spans the distance between second legs 90 so as to form an aesthetic closure.

Figure 19:
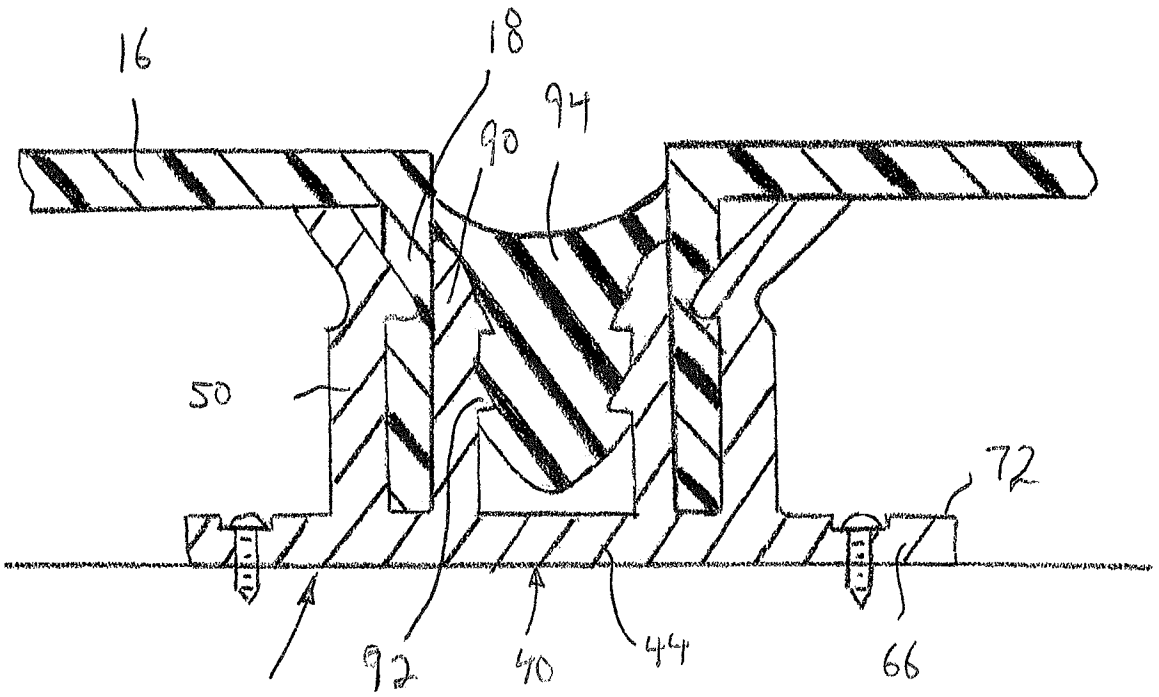
FIG. 19 is a cross-sectional view showing two wall panels connected together by a frame extrusion according to another embodiment of the present invention.

FIG. 19 shows another embodiment similar to that of FIG. 18, in which the main fastening extrusion 138 includes second legs 90 extending upwardly from central planar wall 44 of base section 40, and first legs 88 are eliminated. The inner facing surfaces of second legs 90 are further provided with barbs 92 that are angled toward base section 44. In this manner, a plug 94 can be inserted within the gap between second legs 90 for closing off the gap and providing an aesthetic appearance, with the plug 94 engaged by barbs 92.

Figure 19B:
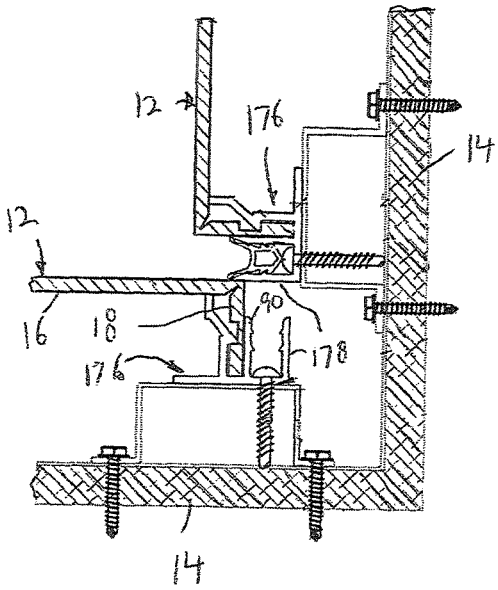
FIG. 19B is a cross-sectional view showing two wall panels connected together at a corner of an inner wall surface by the corner fastening extrusions of FIG. 19A.
Figure 19A:
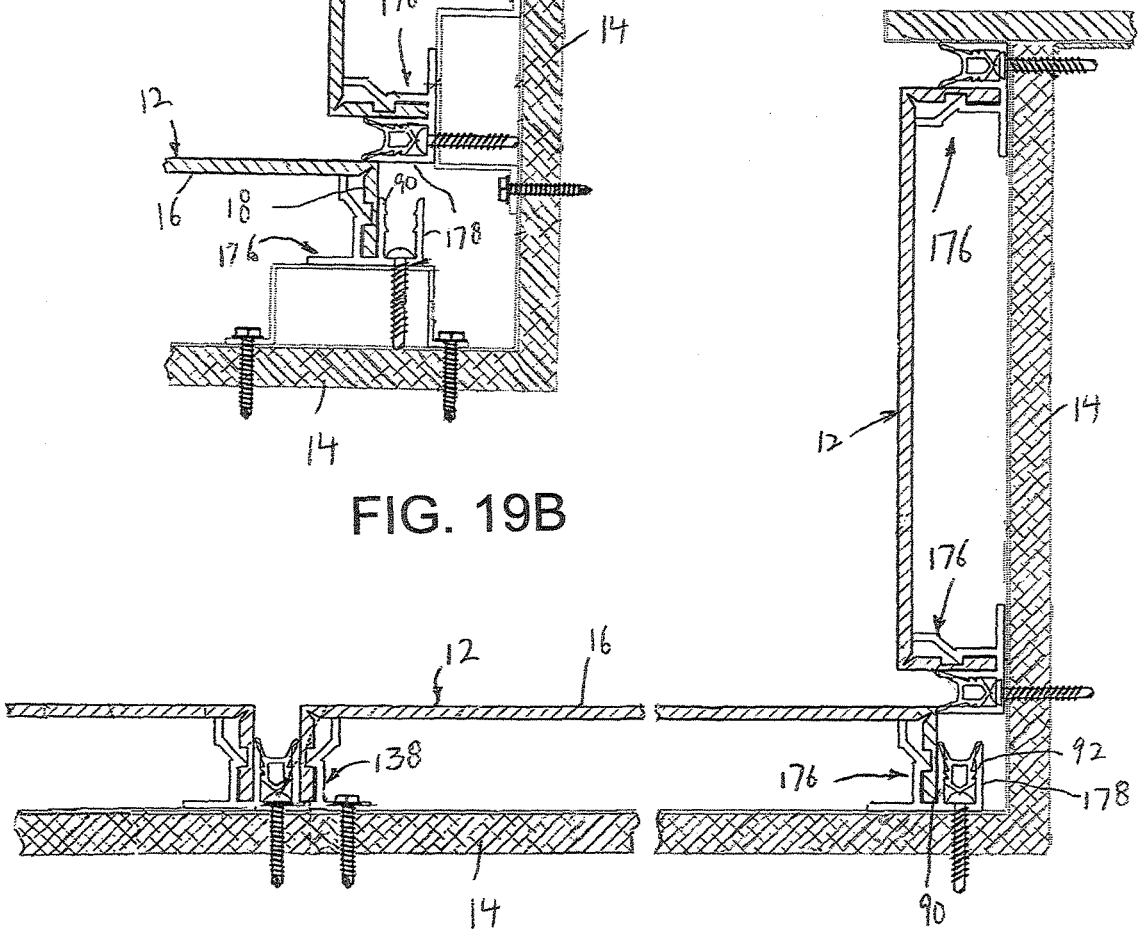
FIG. 19A is a cross-sectional view showing wall panels connected together by the frame extrusion of FIG. 19 at an inner wall surface, along with a corner fastening extrusion therefor.
Figure 19C:
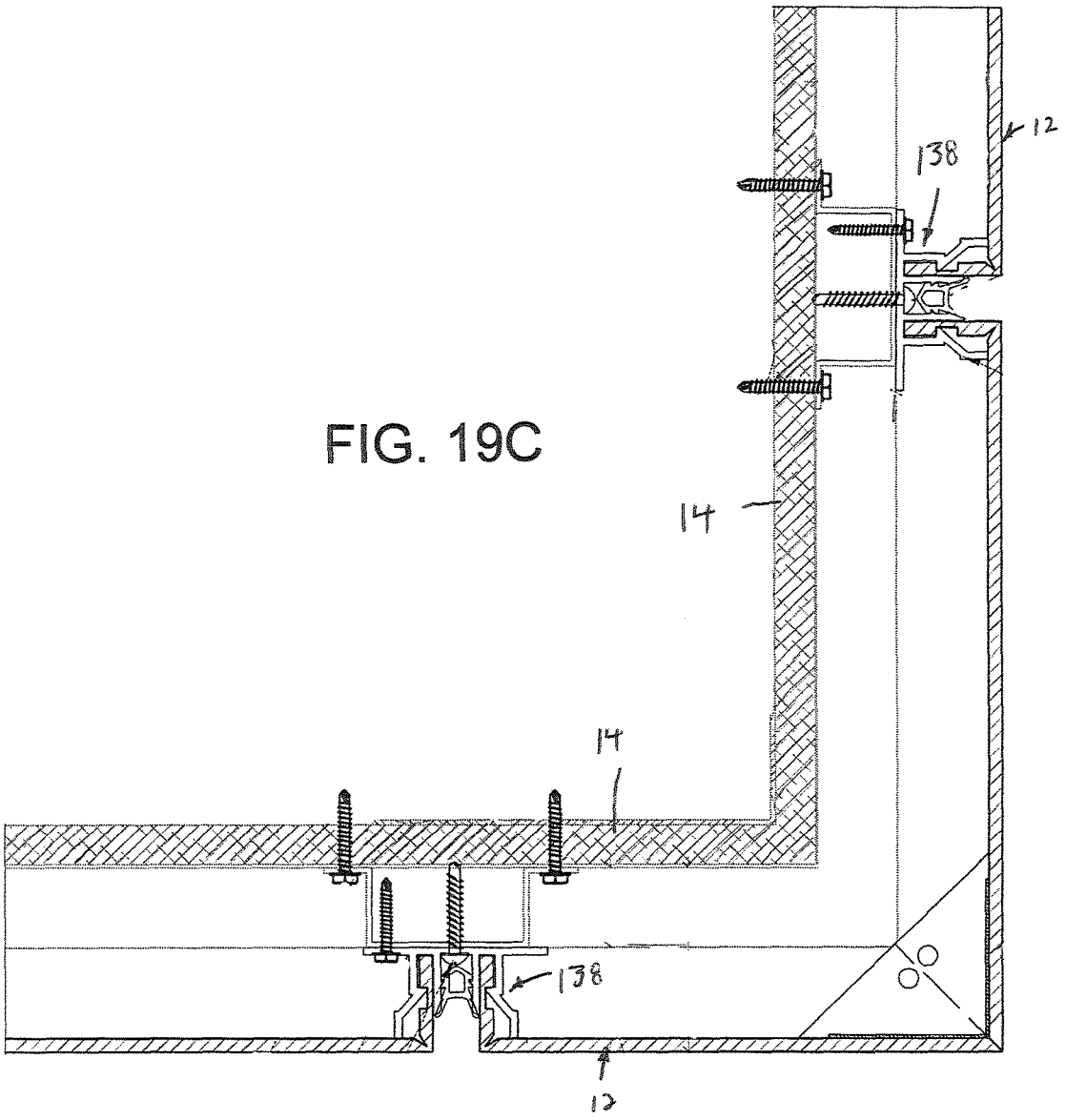
FIG. 19C is a cross-sectional view showing wall panels connected together by the frame extrusion of FIG. 19 at an outer wall surface.

FIG. 19A shows main fastening extrusion 138 of FIG. 19 used for securing wall panels 12 to an inner surface of an existing wall structure 14 of a building. In this case, each corner fastening extrusion 176 essentially corresponds to one-half of main fastening extrusion 138, and further includes a third leg 178 extending upwardly from planar wall 144 in spaced, parallel relation to second leg 90, and into which a plug 94 can be fit. In this regard, the inner surface of third leg 178 also includes barbs 92 which face the barbs 92 of second leg 90. In FIG. 19A, the corner at which planar main panel section 16 and a bent end section 18 meet abuts against the top of third leg 178 and is coplanar therewith. However, the present invention is not limited thereby, and as shown in FIG. 19B, the top surface of planar main panel section 16 at the end thereof can be positioned against the outer surface of third leg 178 at the upper edge thereof. FIG. 19C shows main fastening extrusion 138 of FIG. 19 used for securing wall panels 12 to an outer surface of an existing wall structure 14 of a building.

It will be appreciated that the securement of the wall panels in FIGS. 14-19 occurs in the same manner discussed above with respect to the embodiments of FIGS. 6-8.

It will be further appreciated that, in accordance with the present invention, the cut-out section can be provided in the inner facing surface of each bent end section 18 and the projection can be provided in the outer facing surface of the extrusion.

It will be still further appreciated that, in each of the above embodiments, it is preferable that cut-out sections 32 extend through the outer facing thin aluminum wall 22 and through most or all of polyethylene core 20.

With all of the above embodiments, each wall panel 12 is preferably formed from a planar blank 100 shown in FIG. 20, which is formed preferably by, but not limited to, a polyethylene core 20 with a thin aluminum wall 22 covering opposite sides thereof, as shown in FIGS. 5, 21 and 22. Each planar blank 100 can be stamped from or cut from a larger sheet of the respective material.

Specifically, each planar blank 100 is formed by planar main panel section 16 which is preferably, but not limited to, a square shape with all sides being equal. There are four bent end sections 18, each formed as one piece at a respective side edge of planar main panel section 16, and coplanar therewith. A V-shaped cut-out 102 extends through one thin aluminum wall 22 and polyethylene core 20 at the connecting edge of each bend end section 18 to the side edge of planar main panel section 16, as best shown in FIG. 21. This permits each bent end section 18 to be bent along its respective V-shaped cut-out 102 at a right angle to planar main panel section 16 in the manner shown, for example, in FIG. 3. Each bent end section 18 further includes cut-out section 32 at the inner surface 26 thereof and spaced slightly away from main panel section 16. Each cut-out section 32 can take any suitable shape, such as the nose-shaped configuration in cross-section of FIG. 3, the rectangular configuration in cross-section of FIG. 15, the part-cylindrical configuration in cross-section of FIG. 11, etc., or any other suitable configuration.

Figure 23:
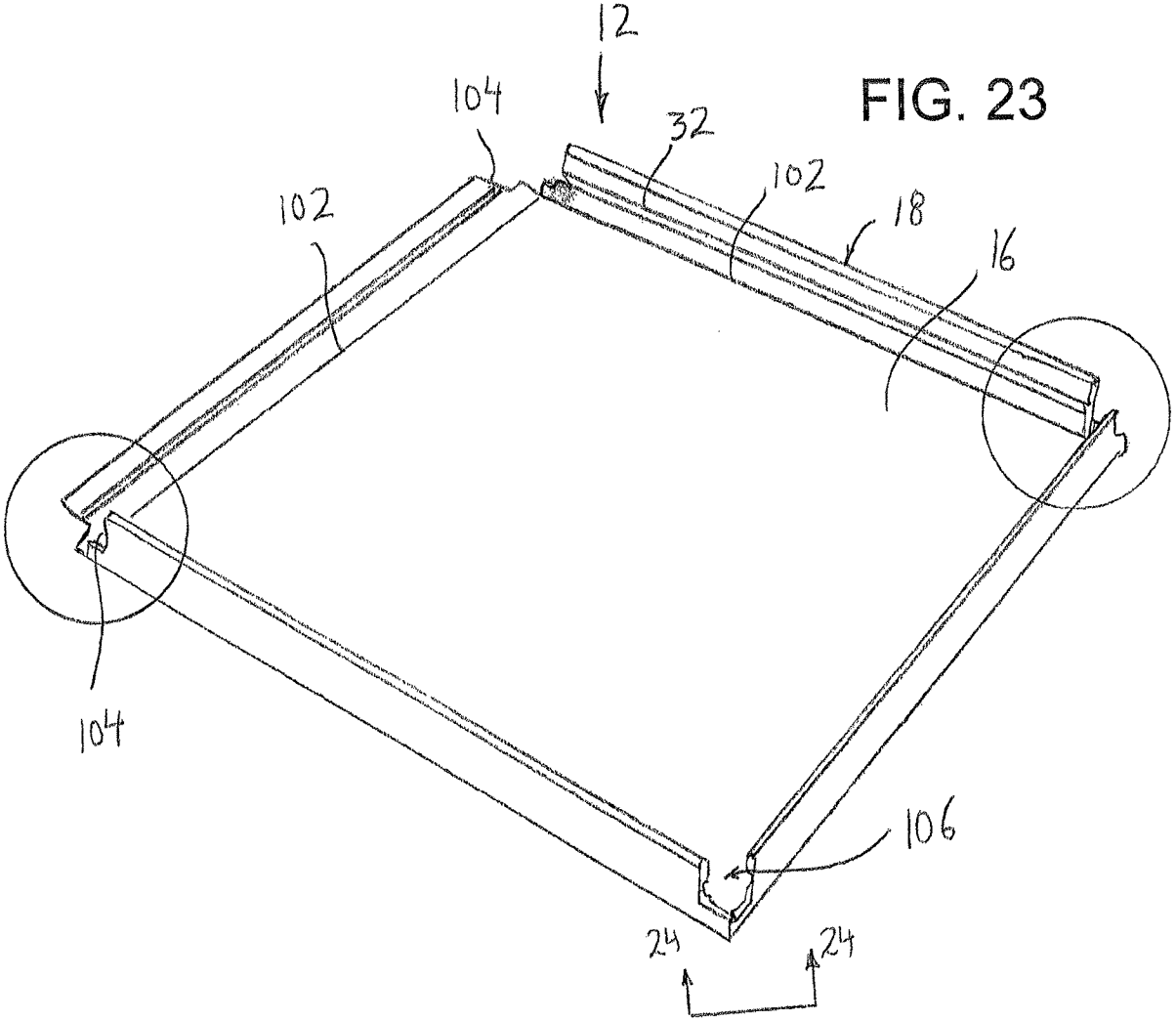
FIG. 23 is a perspective view of the blank of FIG. 20, with three bent end sections bent at right angles with respect to the planar main panel section.
Figure 24:
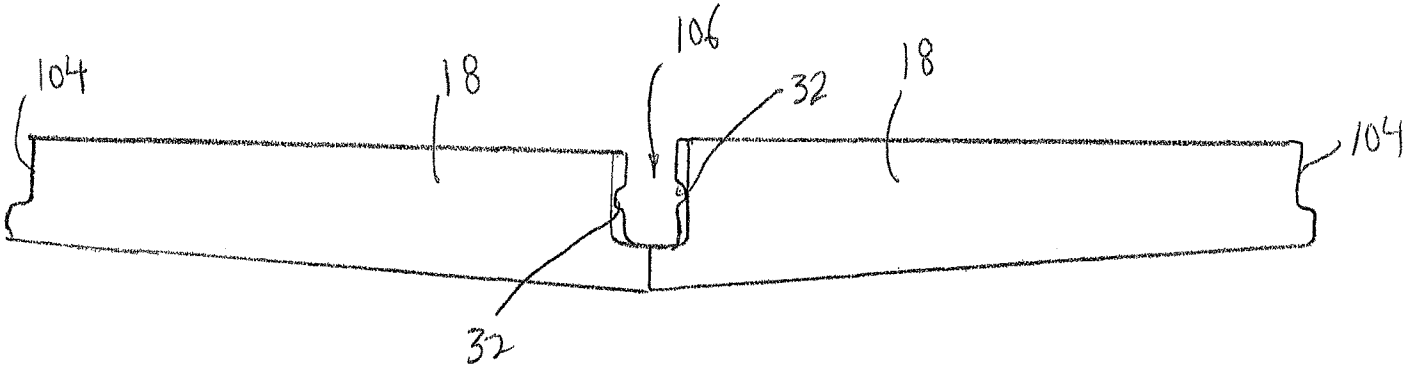
FIG. 24 is an elevational view of the blank of FIG. 23, viewed along line 24-24.
Figure 25:
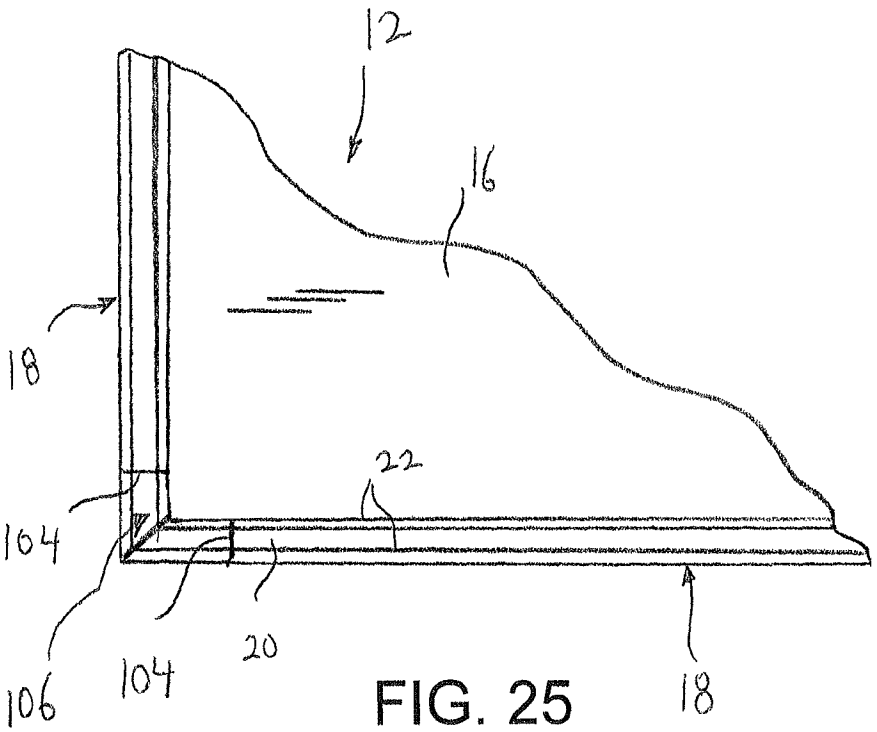
FIG. 25 is a top plan view of one of the corners which is circled in FIG. 23 where two bent end sections are both bent at rights angles with respect to the planar main panel section.
Figure 26:
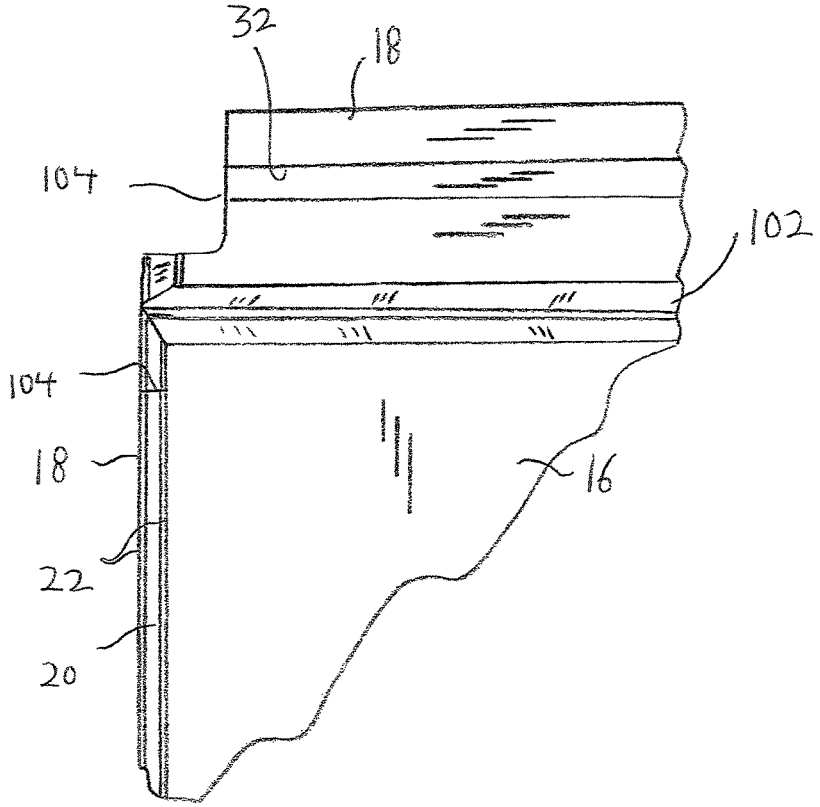
FIG. 26 is a top plan view of one of the corners which is circled in FIG. 23 where only one bent end section is bent at a rights angle with respect to the planar main panel section.
Figure 27:
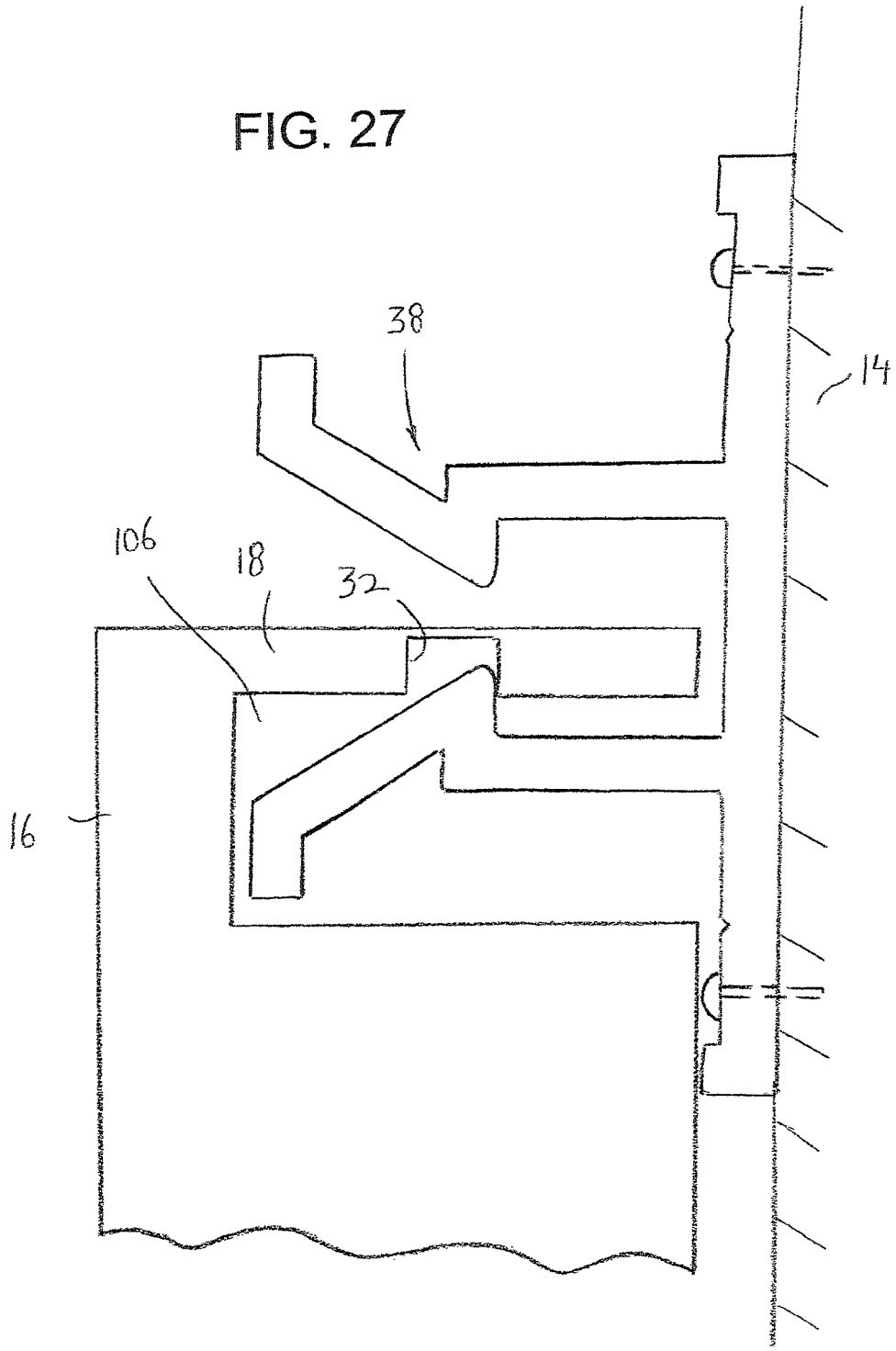
FIG. 27 is an end elevational view of a wall panel hung on a main fastening extrusion for sliding therealong.

In accordance with an important aspect of the present invention, the opposite ends of each bent end section 18 have a rectangular cut-away section 104. Three of the bent end sections 18 are bent along V-shaped cut-outs 102 in FIG. 23 for illustration purposes only, and as.shown in FIGS. 23-25, at the corners where bent end sections 18 are bent at right angles to planar main panel section 16, corner openings or cut-away sections 106 are provided. As a result, when a main fastening extrusion 38, such as the one shown in FIGS. 6 and 27, is secured to an existing wall structure 14, such that it extends along the entire length of the existing wall structure 14, wall panels 12 can merely be hung thereon in the manner shown in FIG. 27 and slid therealong, as a result of corner openings 106.

Of course, it will be appreciated that each corner opening 106 can be formed by a single cut-away section 104, that is, one bent end section 18 at a corner may not include a cut-away section 104.

Further, it will be appreciated that the use of corner openings 106 is used with each of the above embodiments. This is a great advantage over known systems in which the panels have to be carefully placed over the extrusions. With this system, the extrusions are mounted to a wall, and the panels are placed on the extrusions and can be slid therealong so as to be easily adjusted in position. Therefore, there is a great savings in time during construction.

Figure 20A:
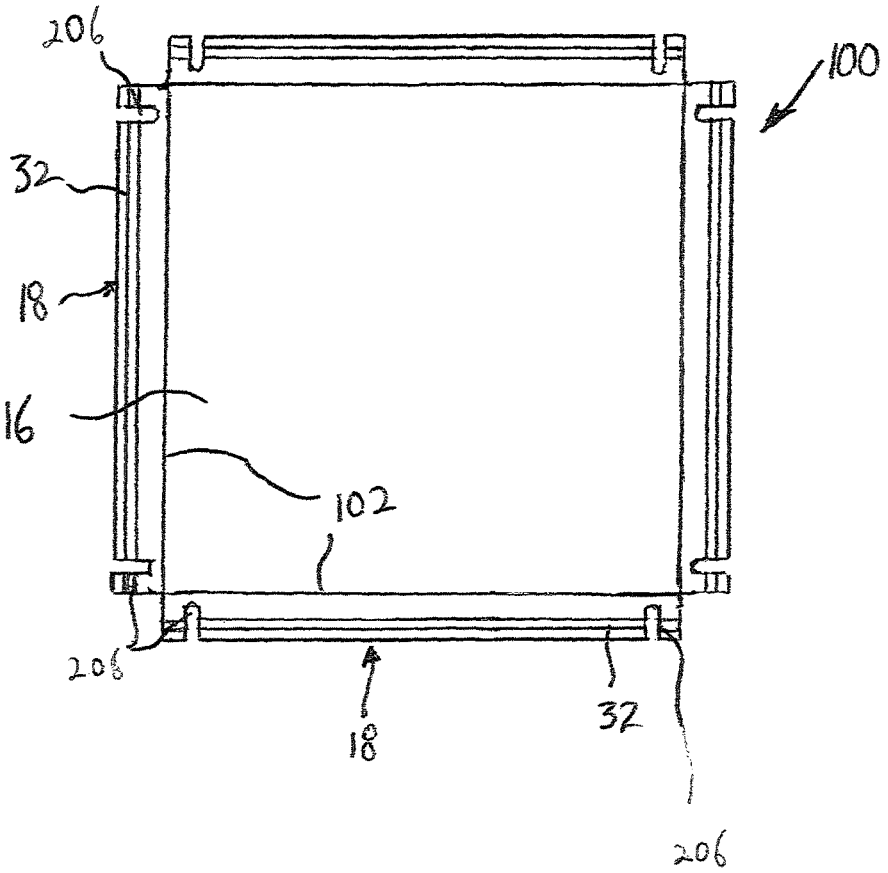
FIG. 20A is a top plan view of a modified planar blank used for forming a wall panel.
Figure 23A:
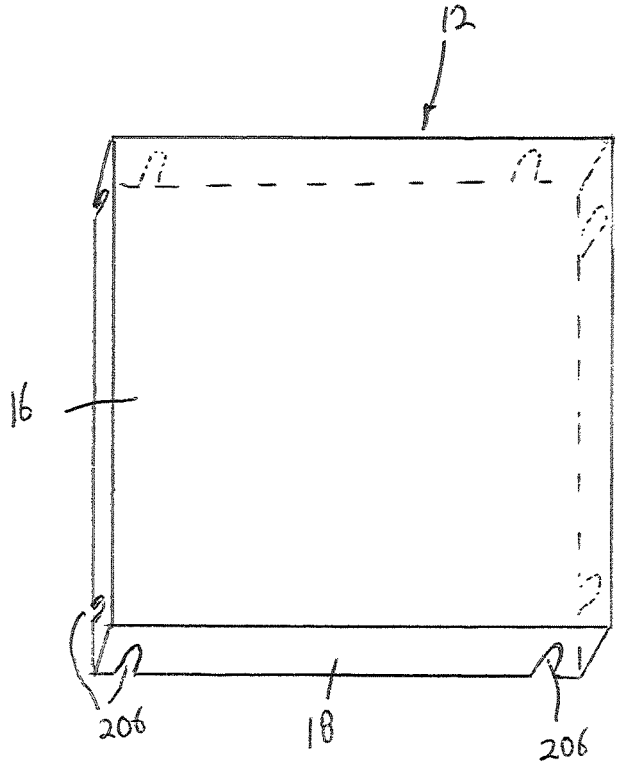
FIG. 23A is a perspective view of the blank of FIG. 20A, with the bent end sections bent at right angles with respect to the planar main panel section.
Figure 23B:
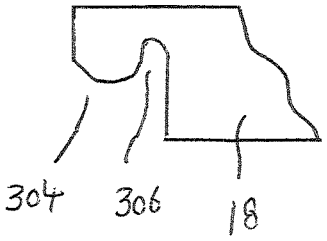
FIG. 23B is a plan view of a portion of one bent end section of a modified wall panel with a combination slot and cut-away section.
Figure 23C:
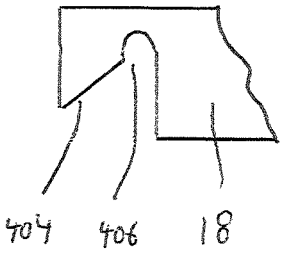
FIG. 23C is a plan view of a portion of one bent end section of a modified wall panel with a combination slot and cut-away section.

As shown in FIGS. 20A and 23A, it will be appreciated that, in place of cut-away sections 104 that from corner openings 106, it is only necessary to provide slots 206 at opposite ends of each bent end section 18 for sliding the wall panels along the extrusions. Thus, a wall panel can be fit on an elongated extrusion and then slid therealong to a desired position, and then snap fit into a parallel, spaced apart extrusion at the opposite end of the wall panel. Alternatively, the wall panel can be snap fit onto two parallel, elongated extrusions and slid therealong to a desired position. Further, the shapes of the slots can vary, as shown in FIGS. 23B and 23C, which take the form of a combination of slot 306, 406 and cut-away sections 304, 404.

Figure 19D:
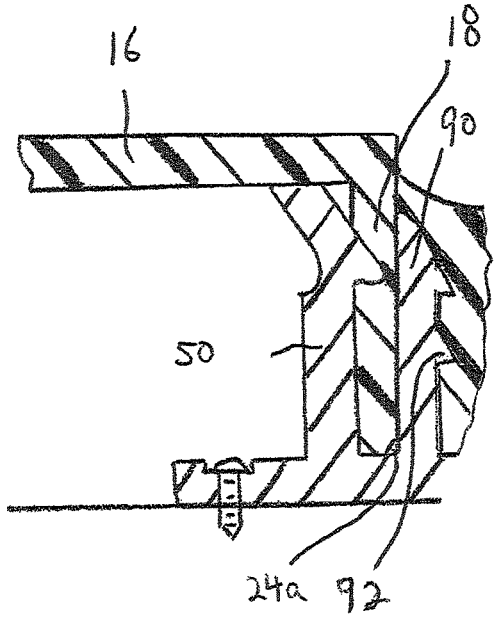
FIG. 19D is a cross-sectional view showing a modified frame extrusion of FIG. 19, with a partially beveled end of the bent end section of the wall panel.
Figure 19E:
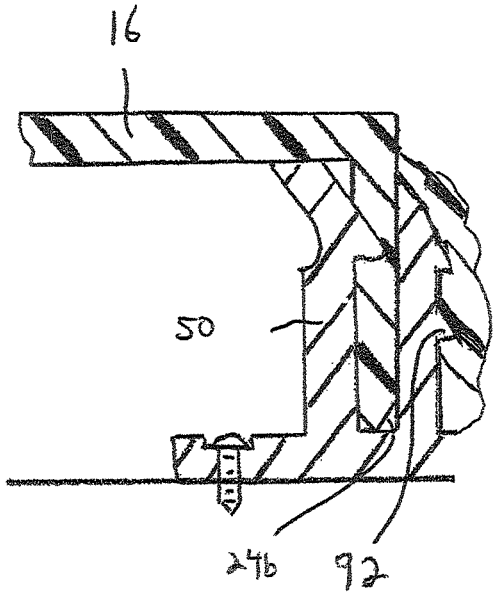
FIG. 19E is a cross-sectional view showing a modified frame extrusion of FIG. 19, with a different partially beveled end of the bent end section of the wall panel.

With all of the above embodiments, the free ends of bent end sections 18 can be formed with a fully beveled end 24, as shown in FIG. 3, a flat end as shown in FIG. 19, or any variation in between, for example, the partially beveled ends having inclined surfaces 24*a* and 24*b* shown in FIGS. 19D and 19E, respectively.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall structure, comprising:

a plurality of wall panels, each wall panel including:

a main wall panel having an outer facing surface, and at least two bent end sections extending at an angle from different edges of said main wall panel, each bent end section having a wall thickness; and at least one main fastening extrusion, each fastening extrusion including:

at least one base section adapted to be secured to the existing wall structure, two spaced apart flexible and resilient bent end securing walls extending at an angle from said at least one base section, the two bent end securing walls having a first spacing therebetween substantially greater than the wall thickness of two said bent end sections, and at least one further wall positioned between said spaced apart bent end securing walls, with a second spacing between said at least one said further wall and each bent end securing wall being substantially equal to the wall thickness of one said bent end section such that facing surfaces of two bent end sections assembled between said at least one further wall and respective said bent end securing walls are parallel with each other and out of contact with each other and spaced apart by a gap equal to at least a width of the at least one further wall from each other entirely along said facing surfaces thereof, said at least one further wall having a distal end that extends to a position spaced from said outer facing surfaces when said wall panels are assembled with said main fastening extrusion;

a cut-out recess at a first surface of at least one said bent end section which faces a second surface of a respective said bent end securing wall;

a projection at the second surface of each said bent end securing wall that faces a respective said cut-out recess, with a third spacing between the projection of each bent end securing wall and the at least one further wall being less than the wall thickness of one said bent end section;

wherein pressing of each said bent end section into a respective said second spacing between one said bent end securing wall and said at least one further wall causes said bent end securing wall to be biased away from said at least one further wall until the respective said projection engages in a respective said cut-out recess to permit said bent end securing wall to spring back to lock said bent end section in said second spacing, with the two bent end sections being completely out of contact with each other.

2. A system according to claim 1, wherein:

each cut-out recess has a cut-out holding surface that is one of:

substantially parallel to said main wall panel, and extending at an angle away from said main wall panel;

each projection has a projection holding surface for engaging with a respective said cut-out holding surface.

3. A system according to claim 2, wherein each said projection has an inclined surface which terminates in the projection holding surface thereof, and each said cut-out has an inclined surface which terminates in the cut-out holding surface thereof.

4. A system according to claim 3, wherein:

each said bent end section has a lower end with a beveled surface for engaging with said inclined surface of the respective said projection when said bent end section is pressed into said spacing between said bent end securing walls to cause the respective said bent end securing wall to be biased away from the other bent end securing wall until said projection engages in the respective said cut-out recess.

5. A system according to claim 1, wherein each said fastening extrusion is formed as a one-piece, unitary construction.

6. A system according to claim 1, wherein each fastening extrusion includes:

at least two separate base sections adapted to be secured to the existing wall structure; and at least two spaced apart flexible and resilient bent end securing walls, each extending at an angle from one of said base sections.

7. A system according to claim 1, further comprising:

a plurality of corner fastening extrusions, each corner fastening extrusion including:

a corner base section adapted to be secured to one corner wall of the existing wall structure, and a flexible and resilient corner bent end securing wall extending at an angle from said base section, each said corner bent end securing wall including a corner projection at one surface thereof facing another adjacent corner wall of the existing wall structure when the base section is secured to said one corner wall, the corner base section having dimensions to space the flexible and resilient corner bent end securing wall from said adjacent corner wall such that a spacing between the adjacent corner wall and the corner projection is less than the wall thickness of one said bent end section, wherein pressing of a said bent end section into said spacing between said corner bent end securing wall and said adjacent corner wall causes said corner bent end securing wall to be biased away from said adjacent corner wall until said corner projection engages in a respective said cut-out recess to lock said bent end section in said spacing in a manner that an outer wall of said bent end section is least in near abutting relation with the adjacent corner wall.

8. A system according to claim 1, wherein:

said at least one base section includes two spaced apart base sections adapted to be secured to the existing wall structure, with a said flexible and resilient bent end securing wall extending at an angle from each base section, and said at least one further wall includes a spacer member positioned between said two base sections, with said spacer member having opposite ends, each end separated from a respective said bent end securing wall by a distance substantially equal to the wall thickness of one said bent end section, wherein each said bent end section has dimensions such that pressing of said bent end section into said second spacing causes the respective said bent end securing wall to be biased away from the spacer member until said projection engages in the respective said cut-out recess.

9. A system according to claim 1, wherein:

said at least one further wall includes two inner walls, each connected to one of:

one said bent end securing wall, and said at least one base section;

each said inner wall connected inwardly of a respective said bent end securing wall, with the second spacing between each bent end securing wall and the respective inner wall of said at least one further wall being substantially equal to the wall thickness of one said bent end section.

10. A system according to claim 9, wherein each inner wall is connected by a lateral connecting wall to a respective said bent end securing wall with a fourth spacing between each lateral connecting wall and said at least one base section, and further comprising a closure member extends in said third spacing.

11. A system according to claim 9, wherein each inner wall is connected to said at least one base section, and a free inner surface of each inner wall is provided with at least one barb that is angled toward said at least one base section, and further comprising a plug inserted between said inner walls and engaged by said barbs.

* * * * *